US008468743B2

(12) United States Patent
Ting et al.

(10) Patent No.: US 8,468,743 B2
(45) Date of Patent: Jun. 25, 2013

(54) BABY GATE OPERABLE HANDS FREE BY DESIGNATED PERSONS

(75) Inventors: Bernie Ting, Hong Kong (CN); Yau Choi Tse, Dalang Town (CN); Siu Hung Chan, Hong Kong (CN)

(73) Assignee: Max Technology Capital Ltd, Road Town (VG)

( * ) Notice: Subject to any disclaimer, the term of this patent is extended or adjusted under 35 U.S.C. 154(b) by 473 days.

(21) Appl. No.: 12/597,065

(22) PCT Filed: Apr. 22, 2008

(86) PCT No.: PCT/US2008/061191

§ 371 (c)(1),
(2), (4) Date: Jul. 14, 2010

(87) PCT Pub. No.: WO2008/131398

PCT Pub. Date: Oct. 30, 2008

(65) Prior Publication Data

US 2010/0293861 A1 Nov. 25, 2010

Related U.S. Application Data

(60) Provisional application No. 60/926,062, filed on Apr. 23, 2007.

(51) Int. Cl.
*E06B 9/01* (2006.01)

(52) U.S. Cl.
USPC ..... 49/57; 49/55; 49/465; 160/180; 292/142; 292/172; 292/137

(58) Field of Classification Search
USPC 49/55, 57, 465, 263, 264, 272–274; 160/180; 292/137, 138, 142, 172, 144, 279, 280; 70/278.7, 279.1, 280–282
See application file for complete search history.

(56) References Cited

U.S. PATENT DOCUMENTS

| | | | | |
|---|---|---|---|---|
| 4,847,485 | A * | 7/1989 | Koelsch | 250/221 |
| 4,893,852 | A | 1/1990 | Harris et al. | |
| 5,379,033 | A * | 1/1995 | Fujii et al. | 340/5.64 |
| 5,963,000 | A | 10/1999 | Tsutsumi et al. | |
| 6,079,157 | A | 6/2000 | Hincher, Sr. | |
| 6,282,931 | B1 * | 9/2001 | Padiak et al. | 70/279.1 |
| 6,418,235 | B1 * | 7/2002 | Morimoto et al. | 382/118 |
| 6,711,857 | B1 | 3/2004 | Wagnitz et al. | |
| 6,862,253 | B2 * | 3/2005 | Blosser et al. | 367/93 |
| 6,910,301 | B2 * | 6/2005 | Kalempa et al. | 49/368 |
| 6,935,000 | B1 * | 8/2005 | Arnaud | 16/239 |
| 7,034,682 | B2 | 4/2006 | Beggs et al. | |
| 7,178,792 | B2 * | 2/2007 | Monahan et al. | 256/73 |
| 7,318,298 | B2 * | 1/2008 | Marsden et al. | 49/57 |
| 2001/0000556 | A1 * | 5/2001 | Rossman et al. | 49/463 |
| 2006/0092378 | A1 * | 5/2006 | Marsden et al. | 352/221 |

* cited by examiner

*Primary Examiner* — Katherine Mitchell
*Assistant Examiner* — Marcus Menezes
(74) *Attorney, Agent, or Firm* — Robert W. J. Usher

(57) ABSTRACT

A baby gate assembly which opens automatically only when detecting a designated person, by IR detection, RFID tagging or voice recognition. One or more IR detectors are mounted on a telescopic mast, enabling designation by height selection and the sensed signal compared with a datum or another IR facing in an opposite direct to provide signal operating reversible stepping motor to unlatch the gate. The control circuitry maintains the gate unlatched for sufficient time for the designated person to push open and walk through the gate in a hands free operation. A pedal release mechanism is also enabling unlatching during a power cut. The automatic and pedal unlatching mechanisms are linked for lost motion permitting independent operation.

20 Claims, 27 Drawing Sheets

BABY GATE OPERABLE HANDS FREE BY DESIGNATED PERSONS

RELATED APPLICATIONS

Priority is claimed from our provisional application No. 60/926,062 filed Apr. 23, 2007, the disclosure of which is incorporated herein by reference.

FIELD OF THE INVENTION

The invention relates to a baby gate assembly for bridging a passageway.

BACKGROUND OF THE INVENTION

Baby gate assemblies have been in widespread use worldwide for many years. However, the prior baby gate assemblies may suffer from various disadvantages such as the inability to distinguish automatically between an infant who must not be allowed to pass through the gate and an adult; the inability of 'hands-free' operation; or a requirement for a technician or skilled operative to fix the gate in position bridging a passageway, especially as passageways can differ in width, which can be not only time consuming and costly but prevent the baby gate being readily moved by the family from place to place in the home.

SUMMARY OF THE INVENTION

An object of the invention are to provide a baby gate assembly which opens for only designated persons so that infants, in particular, cannot pass therethrough.

Another object of the invention is to provide a bay gate assembly which enables hands free operation by only designated persons so that they may push open the gate using their bodies enabling them to operated the gate while both hands are occupied by carrying bulky objects such as bed linen or towels.

An additional object of the invention is to provide a baby gate which can be readily manually adjusted on site by the user to fit passageways of different sizes and can readily be moved between different locations in the home.

According to one aspect, a baby gate assembly comprises:

a barrier frame for bridging a passageway and defining a U-shaped gateway;

a gate mounted in the gateway for swinging movement between open and closed positions, respectively, out of and into alignment with the frame, cooperable latching means on the frame and gate engagable to releasably lock the gate in the closed position;

means on the frame for detecting the presence of a designated (adult) person adjacent the gate and for automatically disengaging the latching means to unlock the gate to permit the designated person detected to open the gate by hands free operation and to walk through the gateway and for automatically re-engaging the latching means to lock the gate when the designated person is no longer detected adjacent the gate;

and, a pedal mechanism on the frame operably connected to the latching means to disengage the latching means to permit a (designated) person to open the gate by hands free operation and to walk through the gateway when the designated person detecting means is inoperable.

The means for automatically disengaging the latching means may comprise a reversing stepping motor operated by signals received from the detection means.

The pedal mechanism is provided only to ensure that the gate can be opened when the automatic gate unlocking means is inoperative, for example, either because of a malfunction or as a result of exhaustion of (battery) power.

The gate is normally spring biased to return to the closed position. The automatic gate unlocking means retains the latching means in the disengaged position throughout detection of the person and for a couple of seconds afterwards to provide sufficient time for the biasing means to return the gate in to alignment with the frame so that the latching means are aligned for re-engagement, before returning the latching means to the re-engaged position. When the pedal mechanism is used however, the latching means will be returned to the engaged position as soon as the pedal is released.

The person may be designated by their height, to prevent an infant actuating the gate opening means, or by a wireless transmitter or other remotely detectable tag on the person's body. Alternatively, a voice recognition system may be used with the automatic unlocking mechanism including a memory circuit mounted on the gate and which can be trained to recognize a particular persons voice thereby to designate that person.

The pedal is spring biased so that it cannot be depressed to release the latch by an unaided infant.

When designation by height is required, the gate unlocking means may comprise at least one infra-red detector positioned to detect and respond only to infra red from a source at a height corresponding to a body height of an adult, and not below such height, The infra red detectors may be mounted on a telescopic mast to permit the detection height to be adjusted as desired when the gate assembly is mounted in a passageway, to accommodate people of different height. Suitably, the detection angle extends from the horizontal plane up through a conical angle of 60 degrees and the detection distance for body temperature is approximately 0.5 meter.

Suitably, two infra red detectors are mounted facing in respective opposite directions on respective opposite sides of the gateway to detect the presence of adults adjacent either side of the gate.

The operational threshold or sensitivity may be a predetermined fixed amount or derived from a comparison of the infra red intensities received by respective detectors More particularly, the U-shaped gateway comprises opposite vertical gate posts joined by a transverse step, one side edge of the gate being pivotally mounted to one gate post and the latching means comprising catch means on an opposite free side edge of the gate and a cooperating catch member mounted on the gate post for movement into and out from engagement with the catch means.

Preferably, the catch member on the frame is linked for lost motion to both the automatic gate unlocking means and the pedal mechanism so that when either one of the automatic gate unlocking means and the pedal mechanism is operated to move the catch member to an unlocked position, the other of the automatic gate unlocking means and the pedal mechanism is not moved by the catch member.

Preferably, the pedal mechanism comprises a pedal operatively connected to depress one end of a rocking lever and the catch member comprises a rod formed with an axially extending slot with a top blind end and mounted for vertical, axial sliding movement on the gate post and having a lower end aligned over an opposite end of the rocking lever, the automatic gate unlocking means having a horizontal spigot received in the slot adjacent the top blind end for vertical relative sliding movement, operation of the automatic gate unlocking mechanism raising the spigot and thereby the rod away from the lever to disengage the catch and unlock the gate without moving the pedal mechanism and so that depression of the pedal will rock the lever to raise the rod to disengage the catch and unlock the gate, with relative vertical sliding movement of the spigot in the slot thereby obviating movement of the automatic unlocking mechanism. When the spigot is lowered to the latching position, the rod falls under gravity lowering the catch member on the frame into latching engagement with the catch means on the gate.

The motor means comprises a reciprocal stepping motor and the spigot is carried by a rack gear plate linked to the motor for vertical reciprocation between upper and lower position actuating detecting microswitches.

The frame has width adjustable, wall mounting means comprising threaded rods threadingly mounted on the frame to extend longitudinally from opposite sides so as to be axially extensible by manual rotation to bring respective fee ends into jamming engagement with opposite walls of a passageway thereby mount the baby gate assembly in passageways of different widths, doorways or between a wall and stir posts.

Locking thumbwheels may be provided to prevent accidental rotation of the threaded rods locking them in a selected axial position ensuring reliable retention of the bay gate assembly in position.

This structure also enables the baby gate to be readily moved from place to place in the home simply by manually loosening the threaded rod locking thumbwheels and rotating the threaded rods.

An extension frame may be also be added on to the frame assembly when required.

The gate comprises a metal frame with a removable (zipped) cover of soft fabric removable for replacement when worn or for cleaning.

As an alternative to detection of body heat infra red, a person may be designated using a HFID trigger, in which an external RFID transmitter with a security code, which constitutes an identification code carried/worn by the user and generates a radio frequency signal detected by to a receiver mounted on the gate assembly. Thus, the gate cannot be unlocked by an infant without an RFID transmitter. The major structure of the gate assembly is similar to that for PIR except the PIR detectors are replaced by the HF signal detector/RFID trigger. The same range of 0.5 meter is adopted.

In practice, the transmitter unit can be tied/worn on the hand like a wrist watch, hung on the waist belt, hand held, or pocketed. The receiver unit must be installed on the side of the gate assembly.

PARTICULAR DESCRIPTION

Specific embodiments of the invention will now be described by way of example only and with reference to the accompanying drawings in which.

Figure 19A:
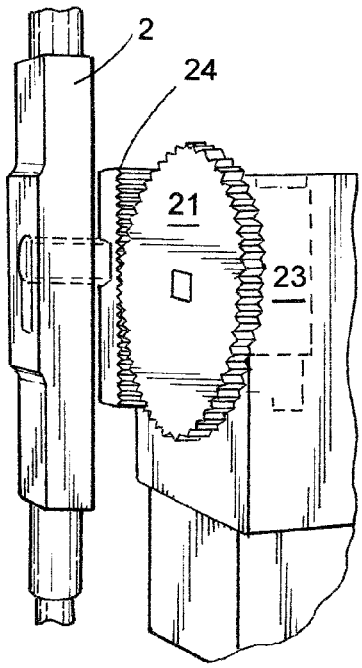
Figure 19B:
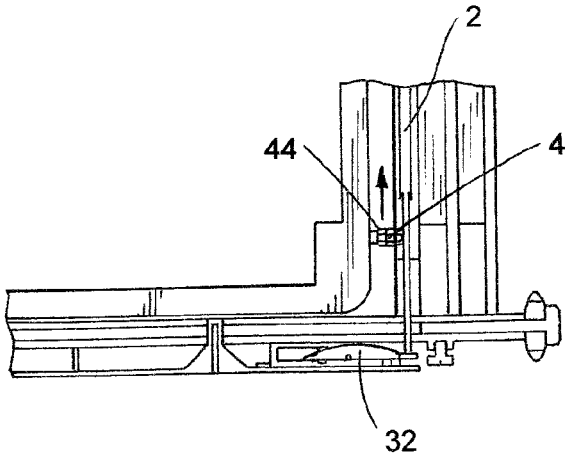

FIG. 19*a* is a fragmentary view showing that the spigot of the gear plate is positioned at the uppermost end of the slot in the latching rod when the latch is on the latching/gate locking position;

FIG. 19*b* is a fragmentary elevational view showing the position of the pedal mechanism when the gate is latched/locked closed and corresponding to the positions of the rod and plate shown in FIG. 19*a;*

Figure 20:
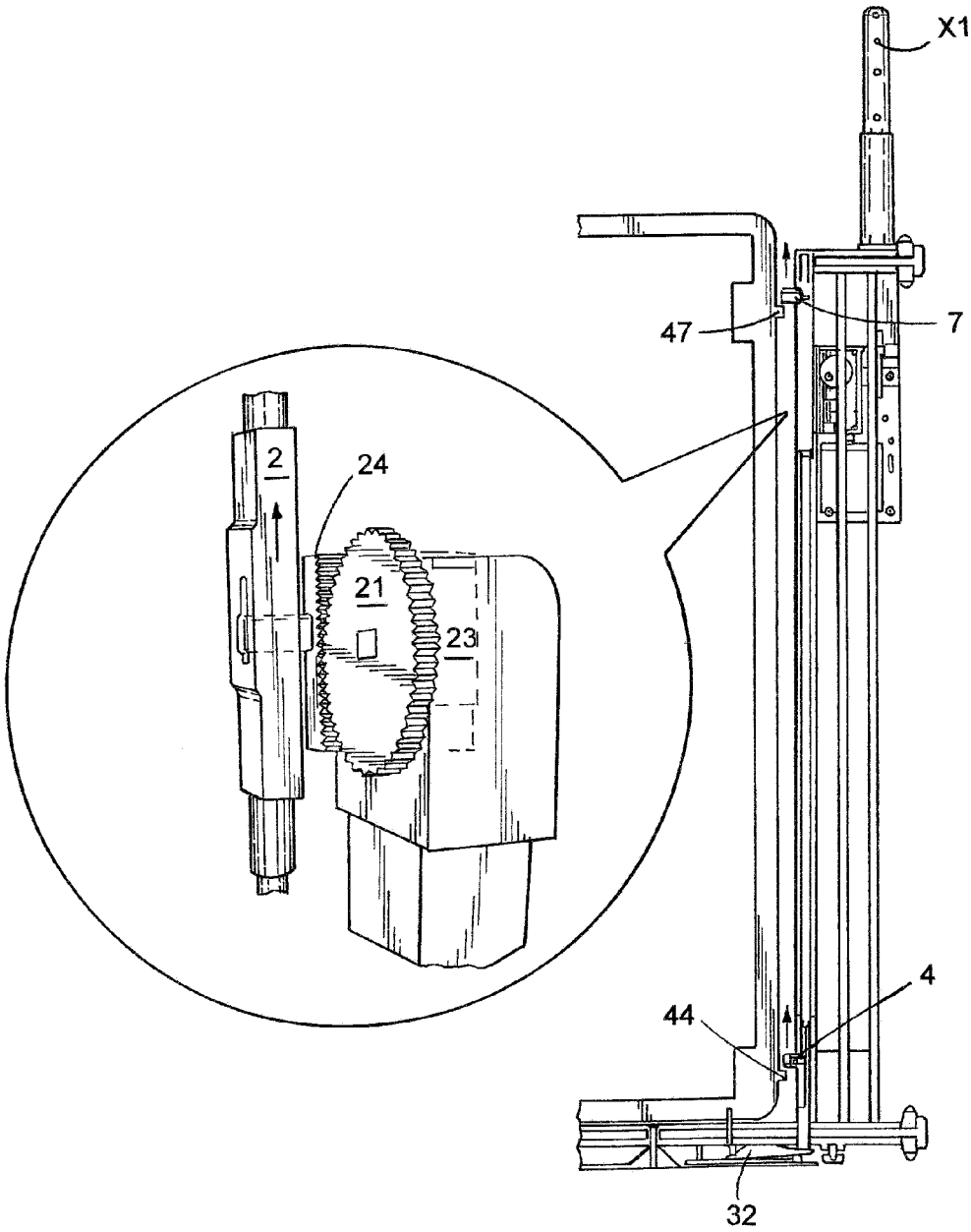
Figure 21A:
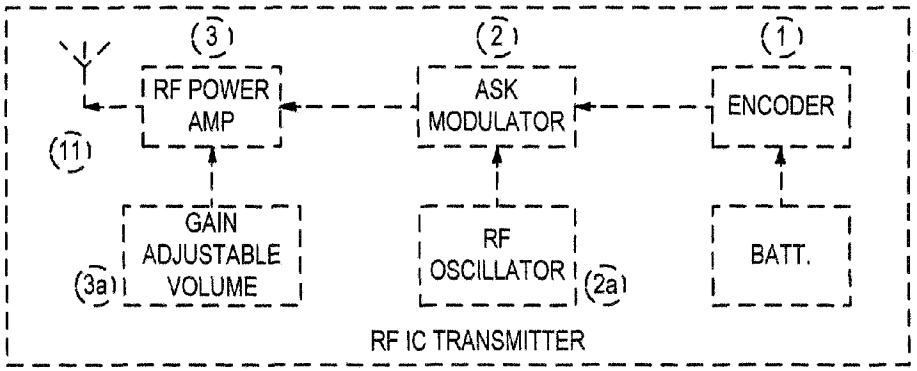
Figure 21B:
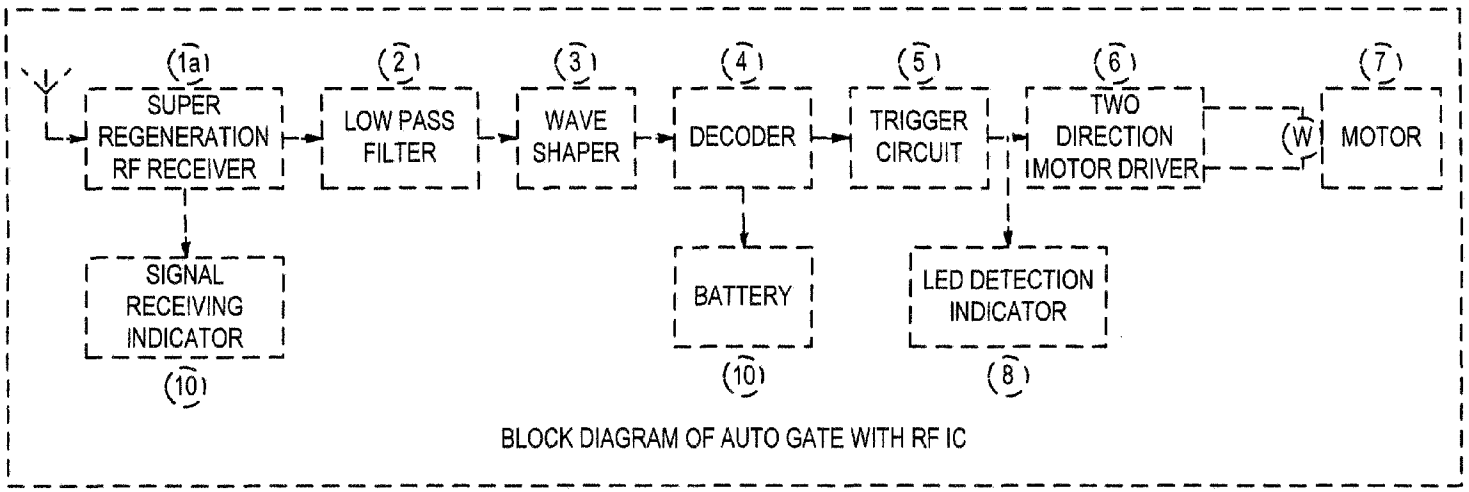
Figure 22B:
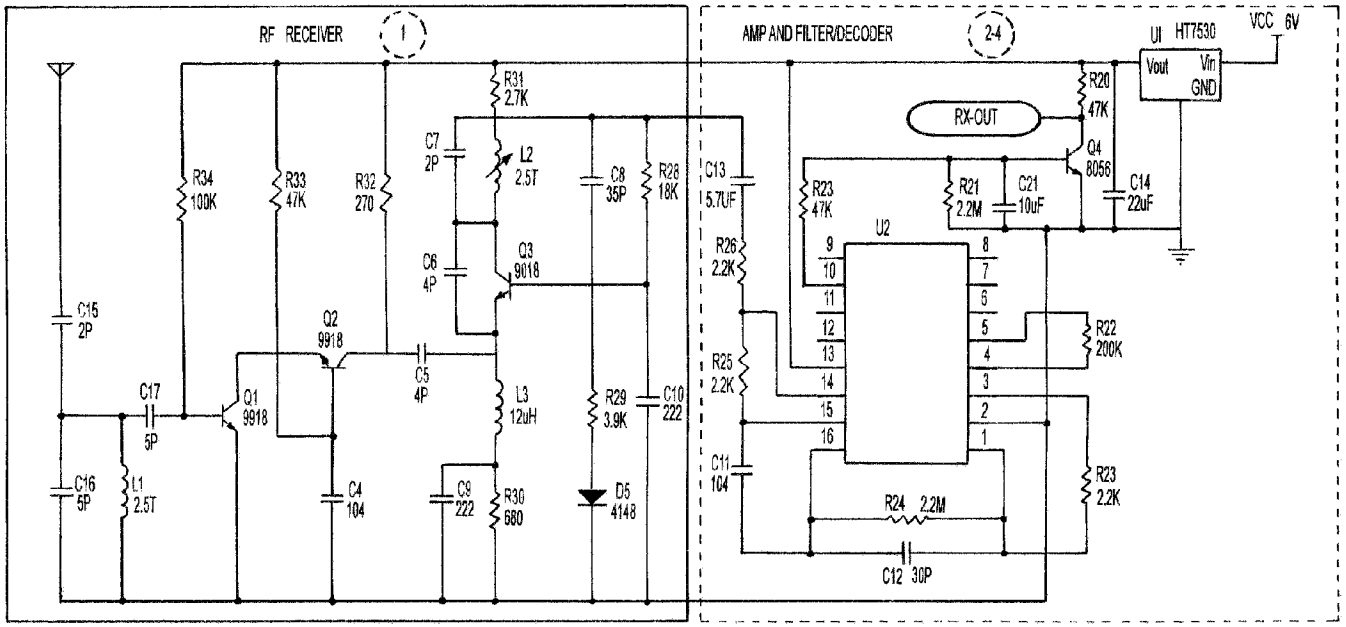
Figure 22A:
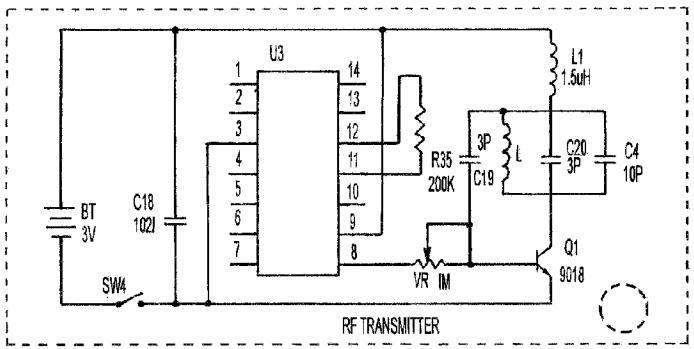
Figure 22B:
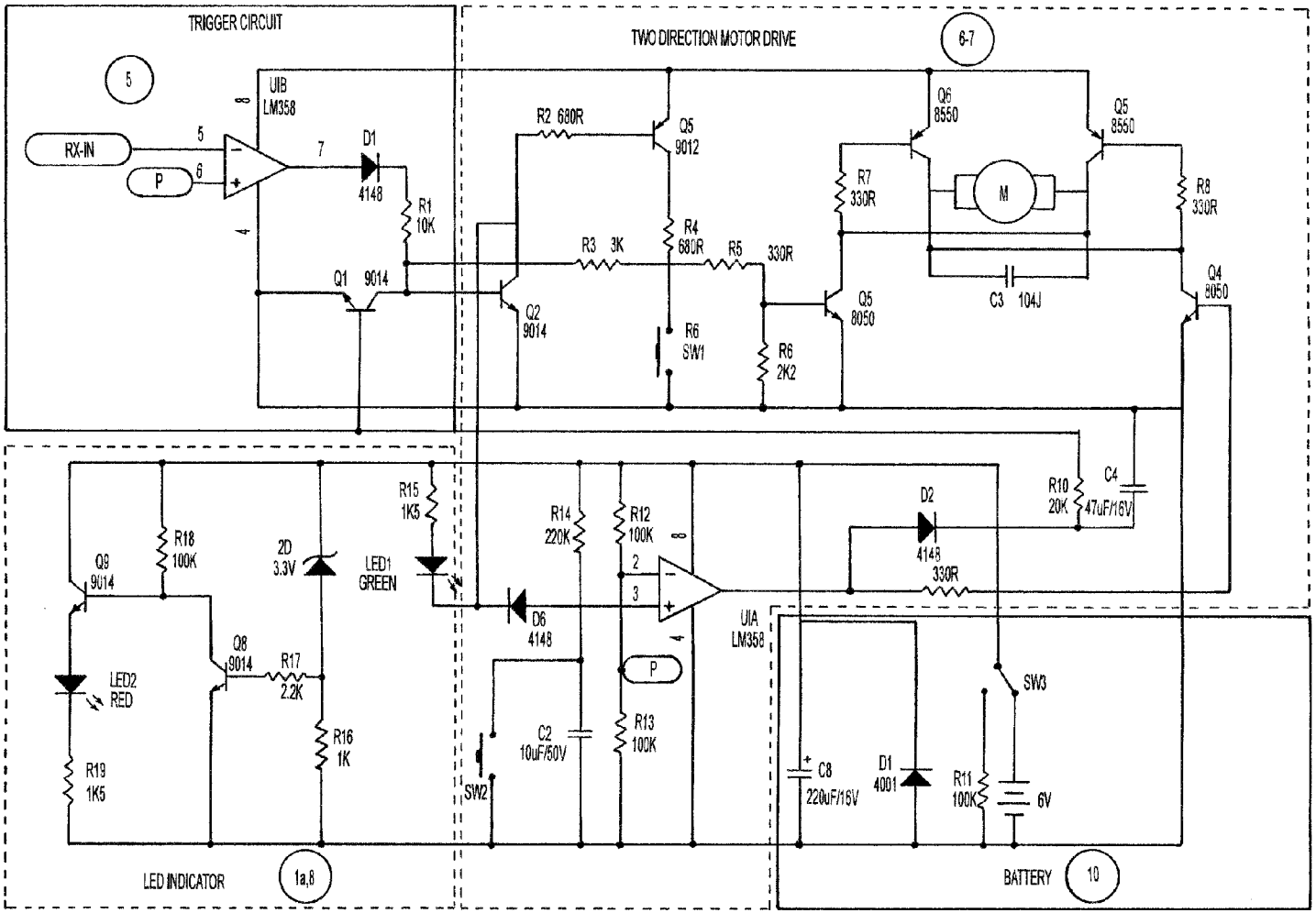
Figure 23:
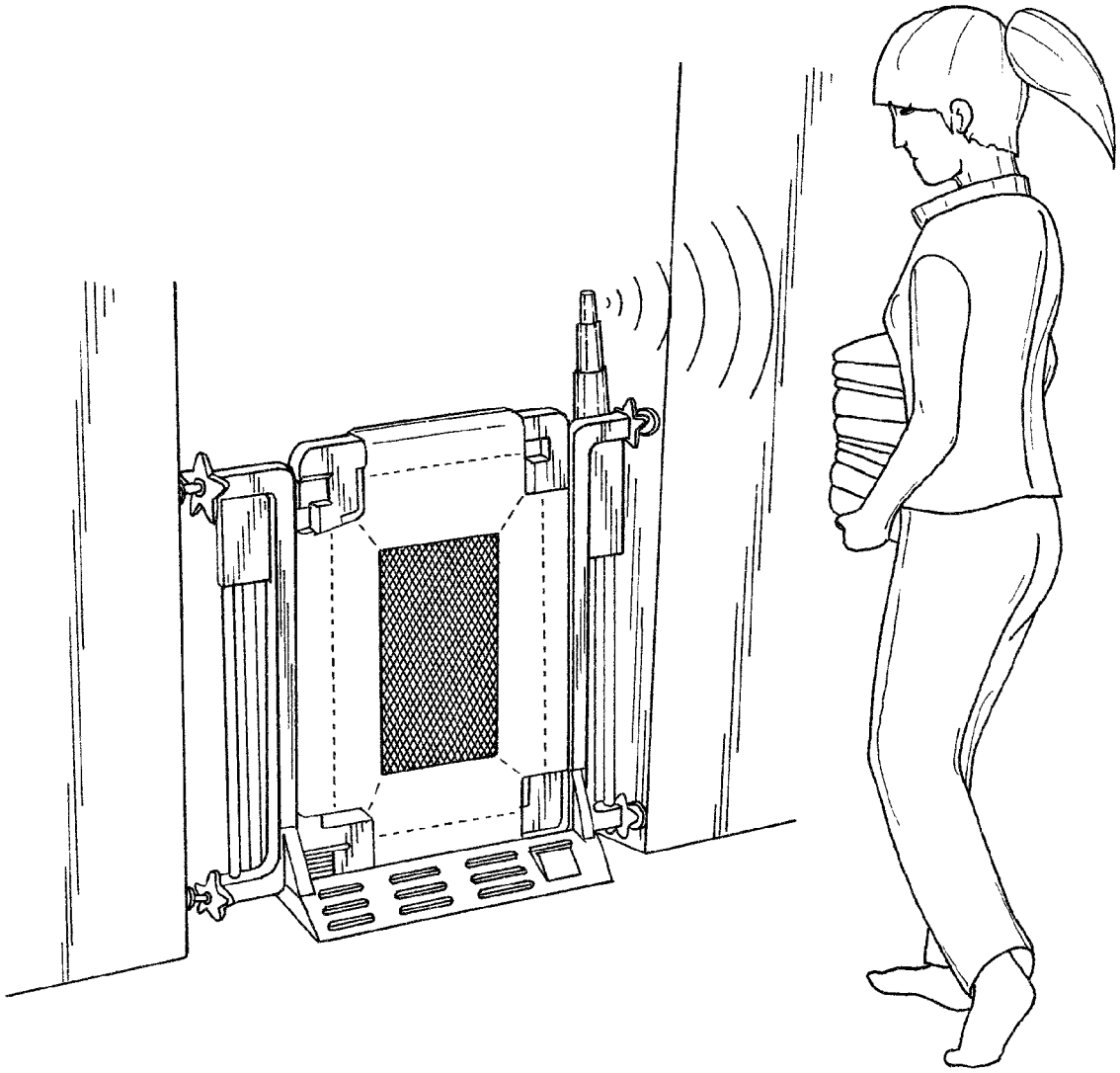
Figure 24:
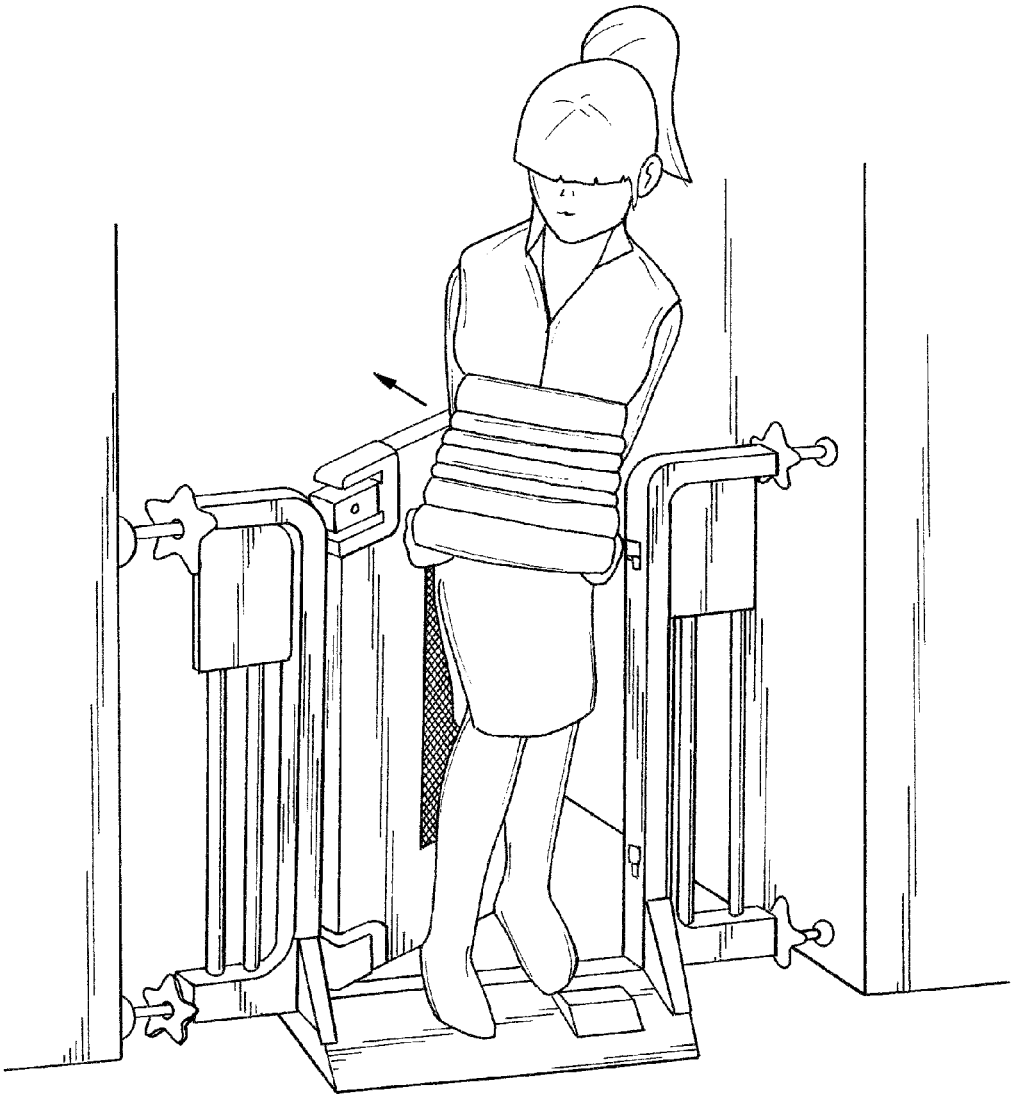
Figure 25:
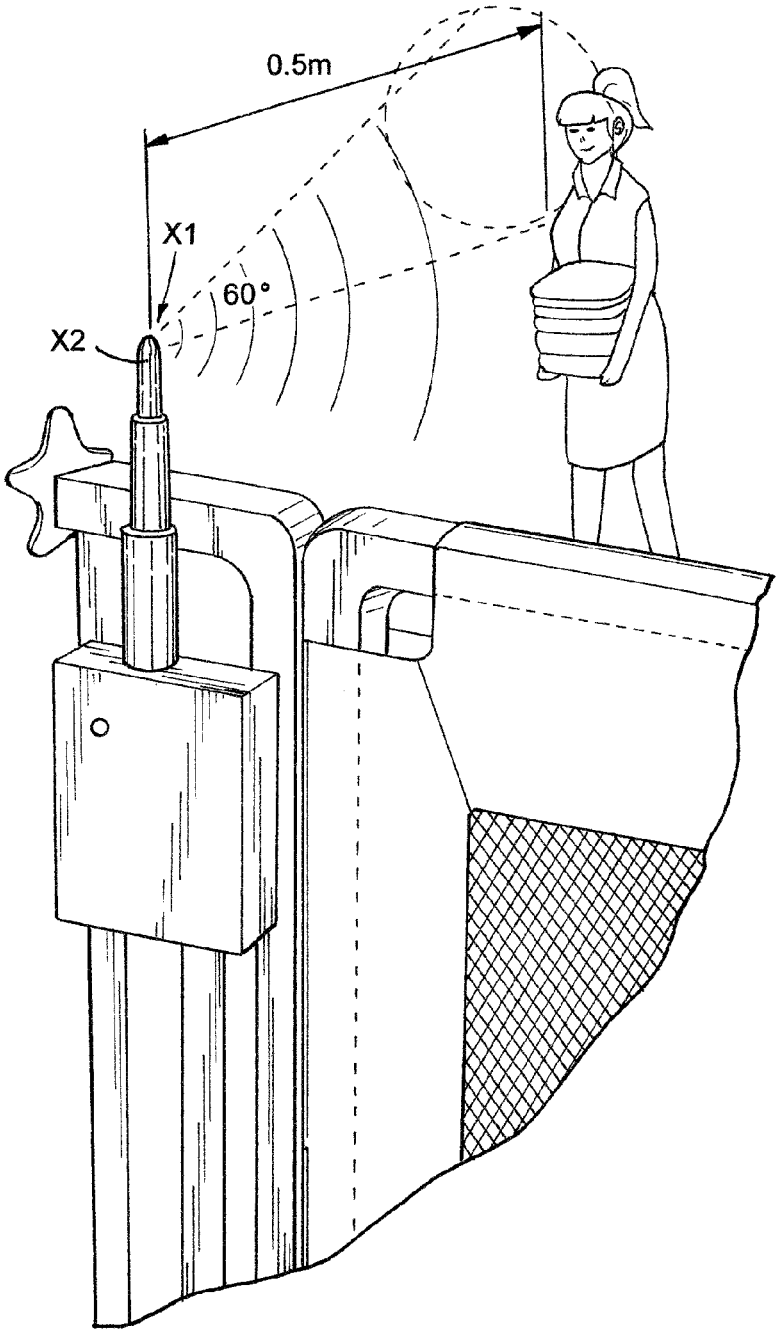
Figure 26:
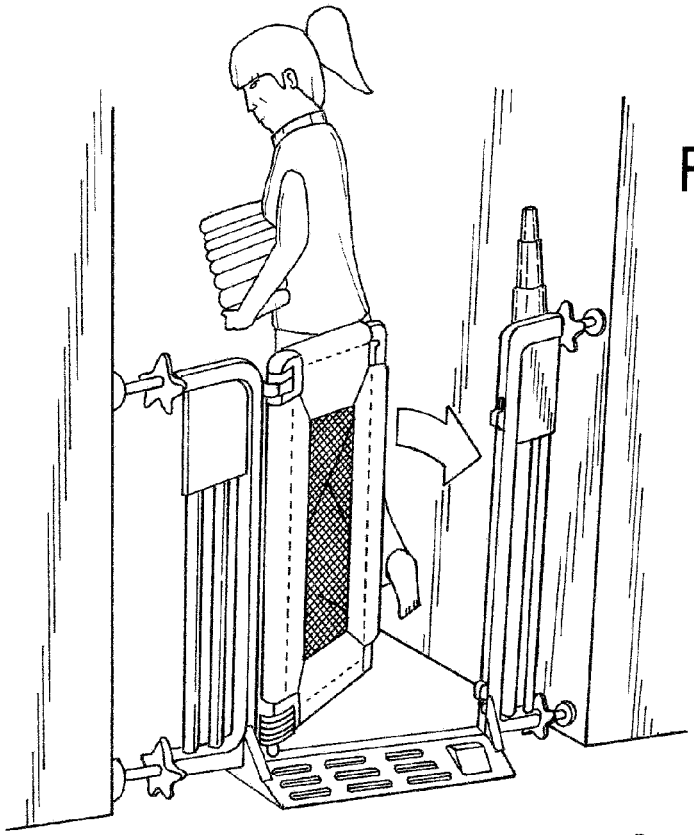
Figure 27:
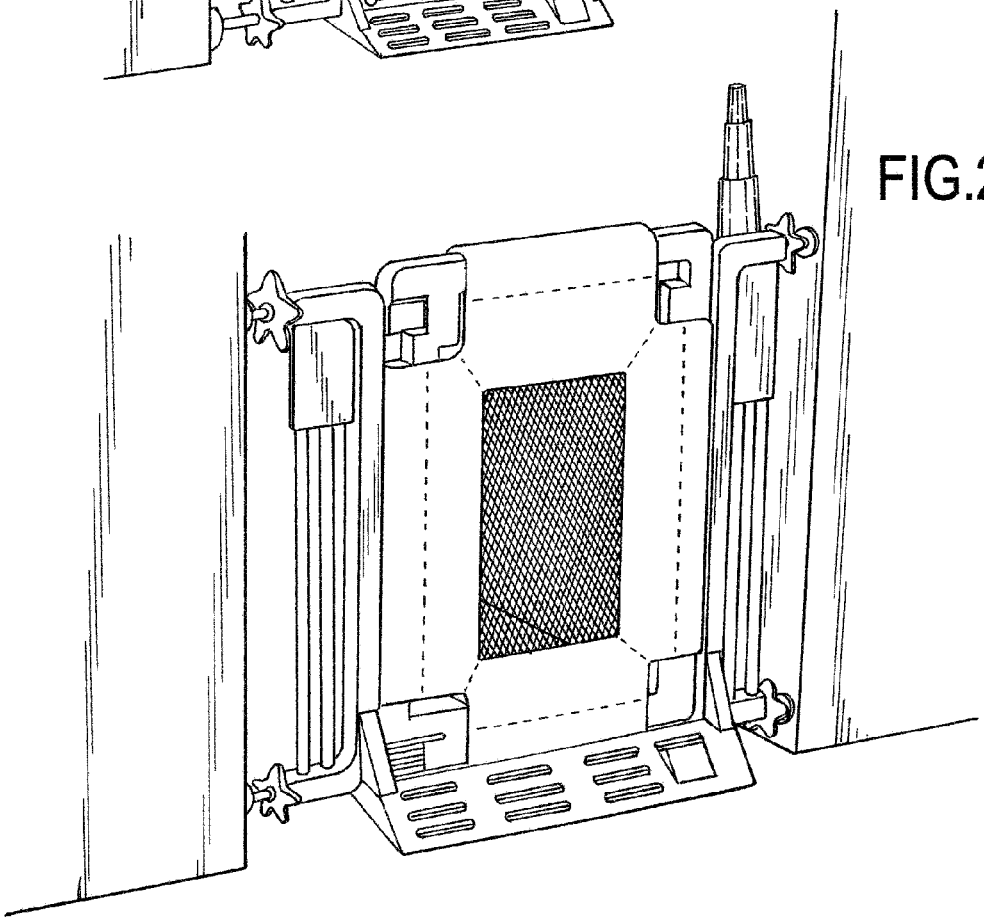
Figure 28:
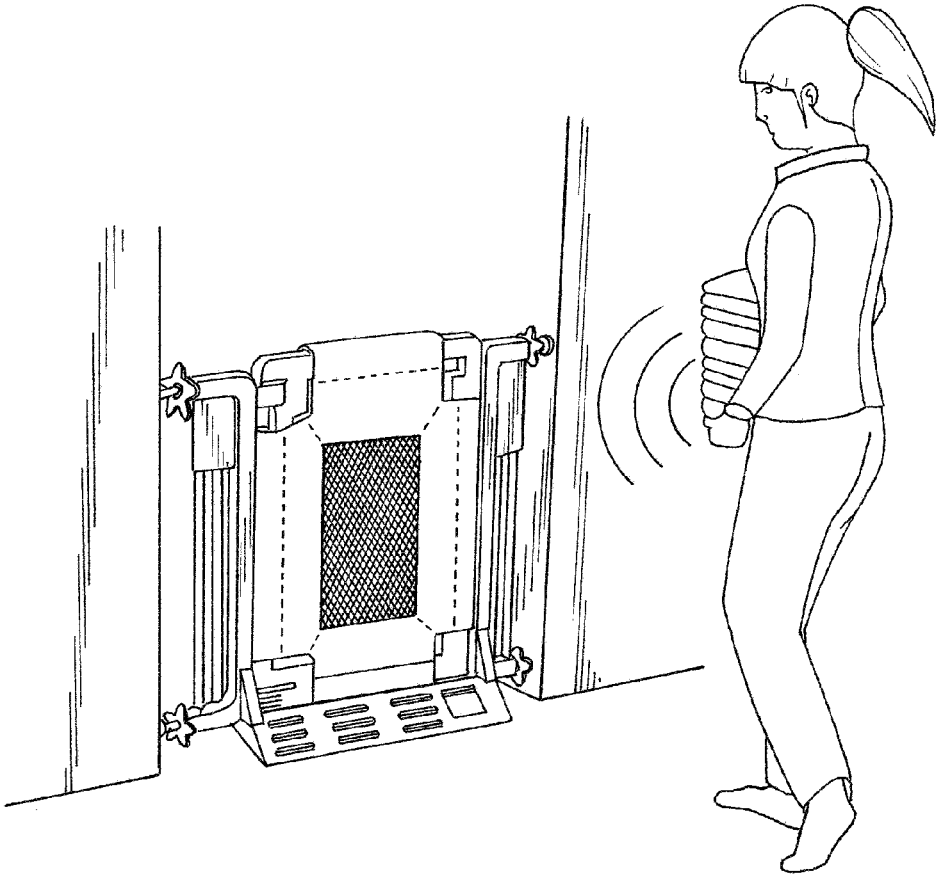

FIG. 20 is a schematic elevational view of the latching mechanism on the barrier frame with the rod raised to the unlatched position by operation of the pedal mechanism showing the lost motion between the spigot of the gear plate and the rod so that pedal unlatching is possible when the motor is inoperable;

FIG. 21*a* is a block diagram of the RFIC transmitter;

FIG. 21*b* is a block diagram of the mains elements of the RFIC receiver;

FIG. 22*a* is a circuit diagram of the transmitter;

FIG. 22*b* is a circuit diagram of the receiver;

FIG. 23 is a schematic perspective showing an adult person laden with linen approaching the gate provided with the PIR detection system;

FIG. 24 is a schematic perspective showing the person laden with linen opening the gate by hands free action after detection by pushing the gate open with her body;

FIG. 25 is a schematic perspective showing the range of the PIR detection;

FIGS. 26 and 27 are schematic perspectives show the gate being returned to the closed position (by the action of biasing spring) and in the closed position after the person is clear of the gate;

FIG. 28 is a schematic perspective showing an adult designated by wearing a RFID trigger wristwatch approaching the gate to cause a sequence of events similar to those illustrated above for PIR detection and gate opening.

PARTICULAR DESCRIPTION

As shown particularly in FIGS. 1-4, a baby gate assembly comprises a U-shape barrier frame 14 for bridging a passageway comprising a pair of spaced apart posts joined by a bottom transverse member surmounted by a step 31 to define a U-shaped gateway and a gate 8 mounted in the gateway for swinging movement between open and closed positions, respectively, out of and into alignment with the frame 14.

Figure 6:
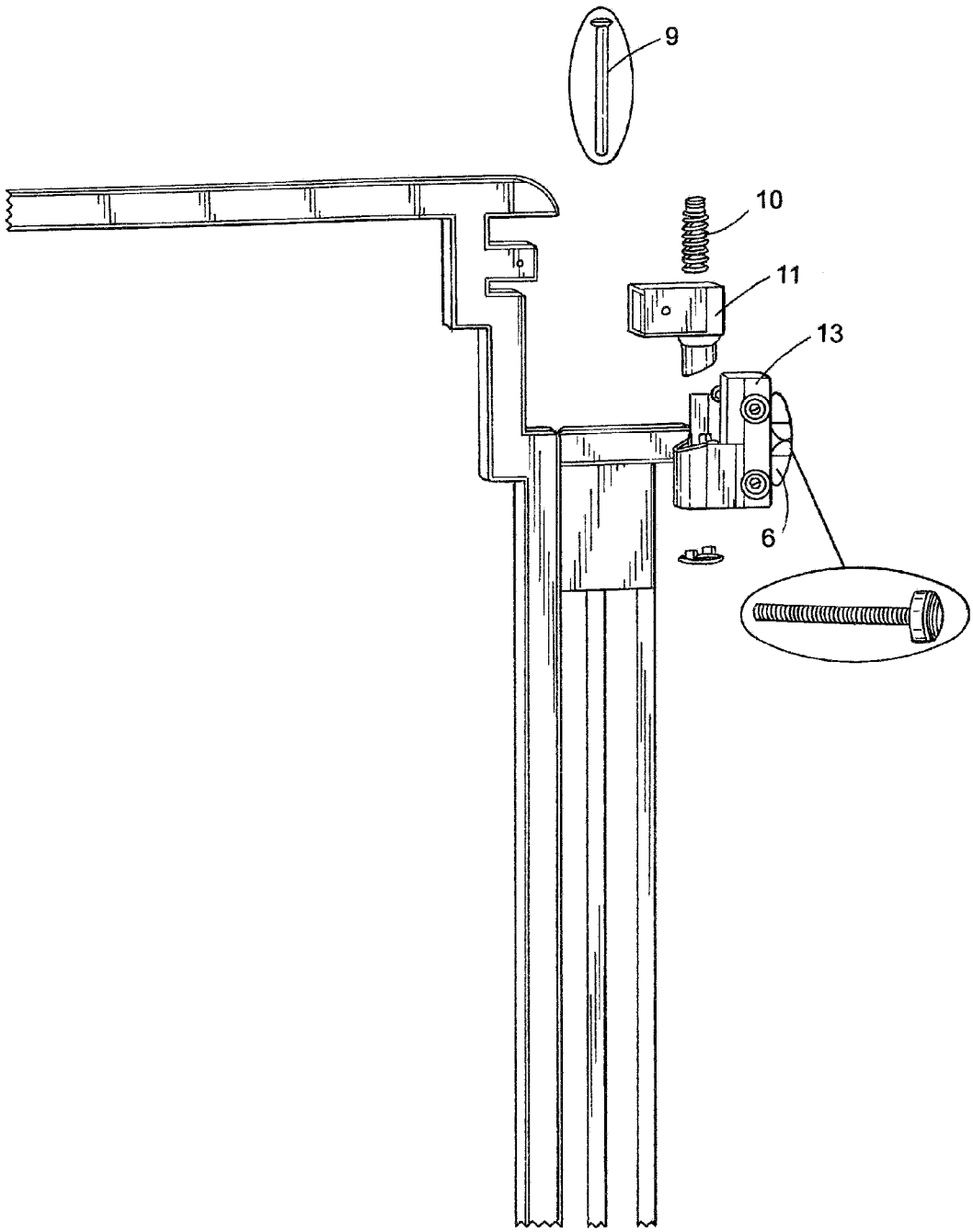
FIG. 6 is a fragmentary exploded perspective view of the gate and barrier frame showing the upper hinge mechansim.
Figure 10:
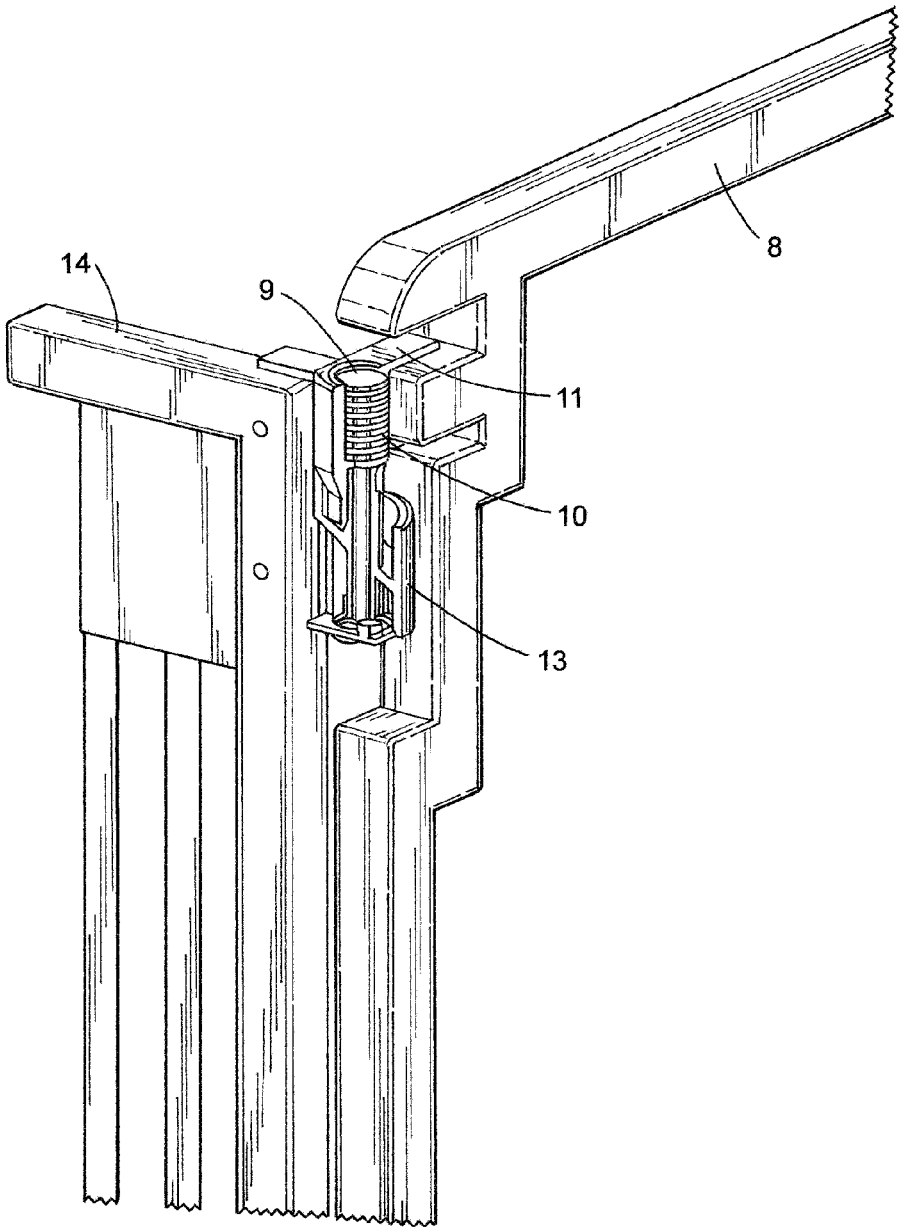
FIG. 10 is a fragmentary perspective view of the hinge of the open gate and the barrier frame showing the compression of the biasing (return) spring between the respective hinge members.
Figure 11:
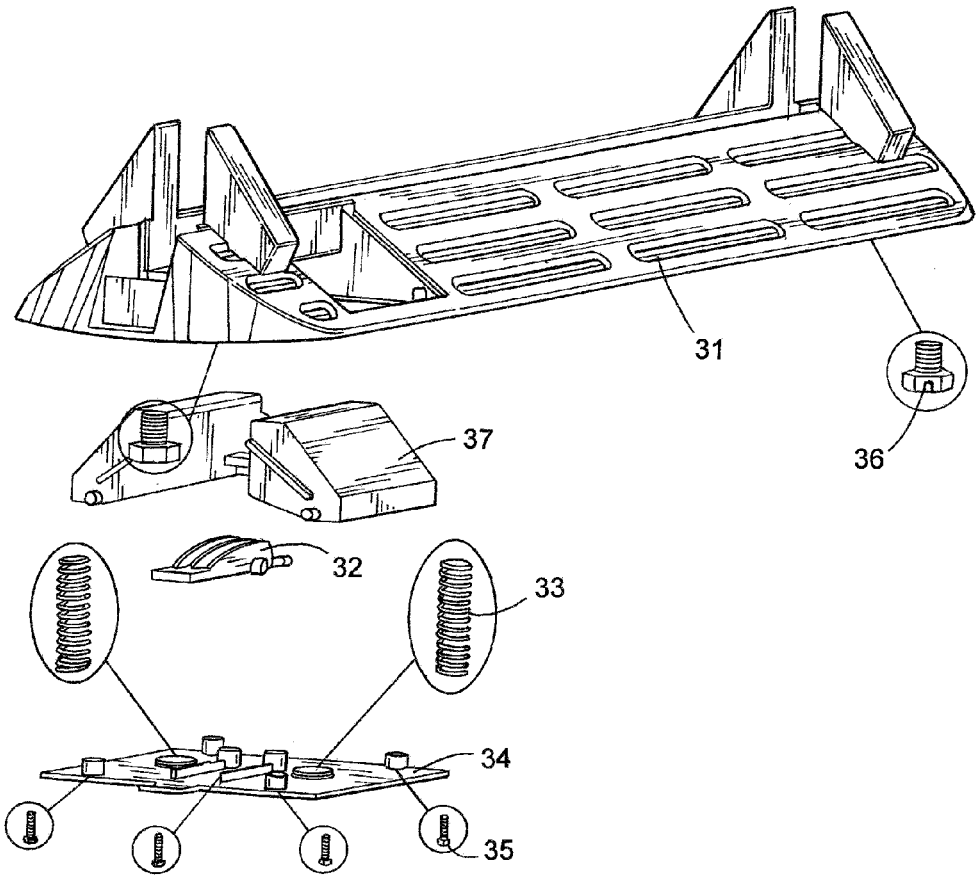
FIG. 11 is an exploded perspective view of the transverse step/ramp and pedal mechanism for unlatching the gate.
Figure 12:
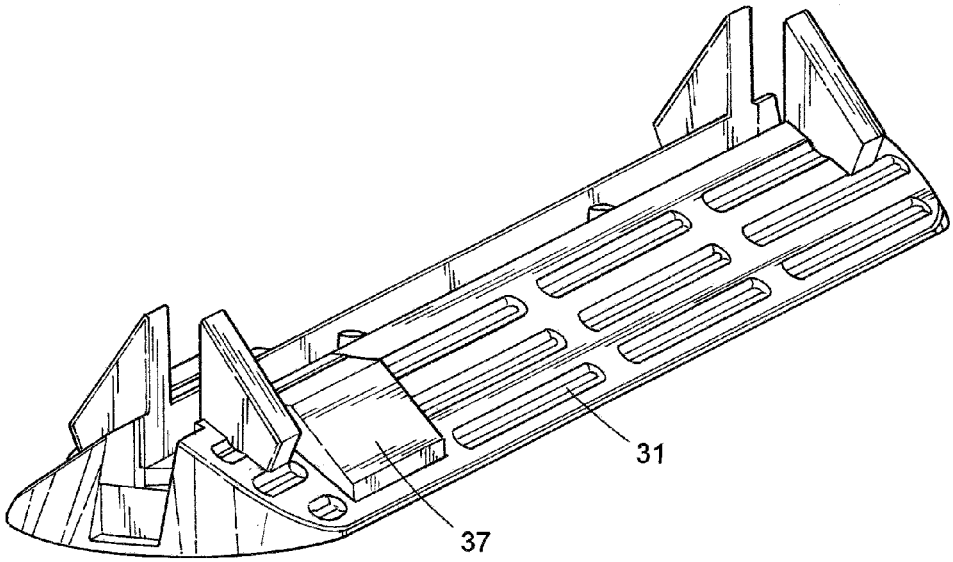
FIG. 12 is a perspective view of the ramp/step with the pedals mounted therein.

One side edge of the gate is pivotally mounted to one gate post 14 by a lower frame hinge member 15 and an upper, rising butt hinge assembly, (shown also in FIGS. 6 and 10), comprising upper (rising) gate hinge member 11 pivotally mounted for travel along an arcuate ramp surface of a upper frame hinge member 13 by hinge pin 9 having an helical biasing spring 10 trapped on an upper thereof for compression by gate opening movement so as to return the gate to a closed position.

Gate latching means comprises a latching rod 2 mounted for vertical sliding movement on a frame post opposite the hinge assembly and carrying an upper, vertically slotted, frame latch retainer 3 and a lower frame latch retainer 5, respectively, holding upper and lower, clevis form, frame latch members 7 and 4, respectively, for latching receipt of tab form latch members on catch means 47,44 on the adjacent side of the gate.

As shown in FIGS. 9, 18, 19*a* and 20, the slot 300 of the frame latch retainer 3 receives at an upper end, a spigot 240 of a rack gear plate 24 reciprocated vertically by pinion gear 21 rotated by output shaft of stepping motor 23, to raise and lower the rod 2 unlatching and latch the gate, respectively, when the gate is operated automatically, as further described below.

In the event of a malfunction of the automatic system or a power cut, the gate can be unlatched by a pedal mechanism, shown in FIGS. 1, 11, 12, 19*b* and 20, which comprises pedals 37 seated on respective compression springs 33 in respective opposite sides of a step/ramp form housing 31 and operatively connected to depress one end of a rocking lever 32 (FIG. 20) having the other end underlying a lower end of the latching rod 2. Depression of the pedal will rock the lever to raise the rod, raising and disengage the latches 7 and 4 to unlatch the gate. As the is spigot of the rack gear plate 24 is located at the top of the slot in the latch position of the mechanism, it is free for relative vertical sliding movement in the slot as the rod is raised to the unlatched position by the pedal operation so that movement of the automatic unlocking mechanism by gate unlatching operation of the pedal mechanism is obviated.

It will be appreciated also that operation of the automatic gate unlocking mechanism raising the spigot and thereby the rod away from the lever to disengage the latches and unlock the gate does not moving the pedal mechanism. When either the spigot is lowered to the latching position by the automatic motor operation, or when pedal pressure is released and the pedal is returned by the biasing spring 33, the rod falls under gravity lowering the latch members on the frame into latching engagement with the latch members on the gate.

Figure 1:
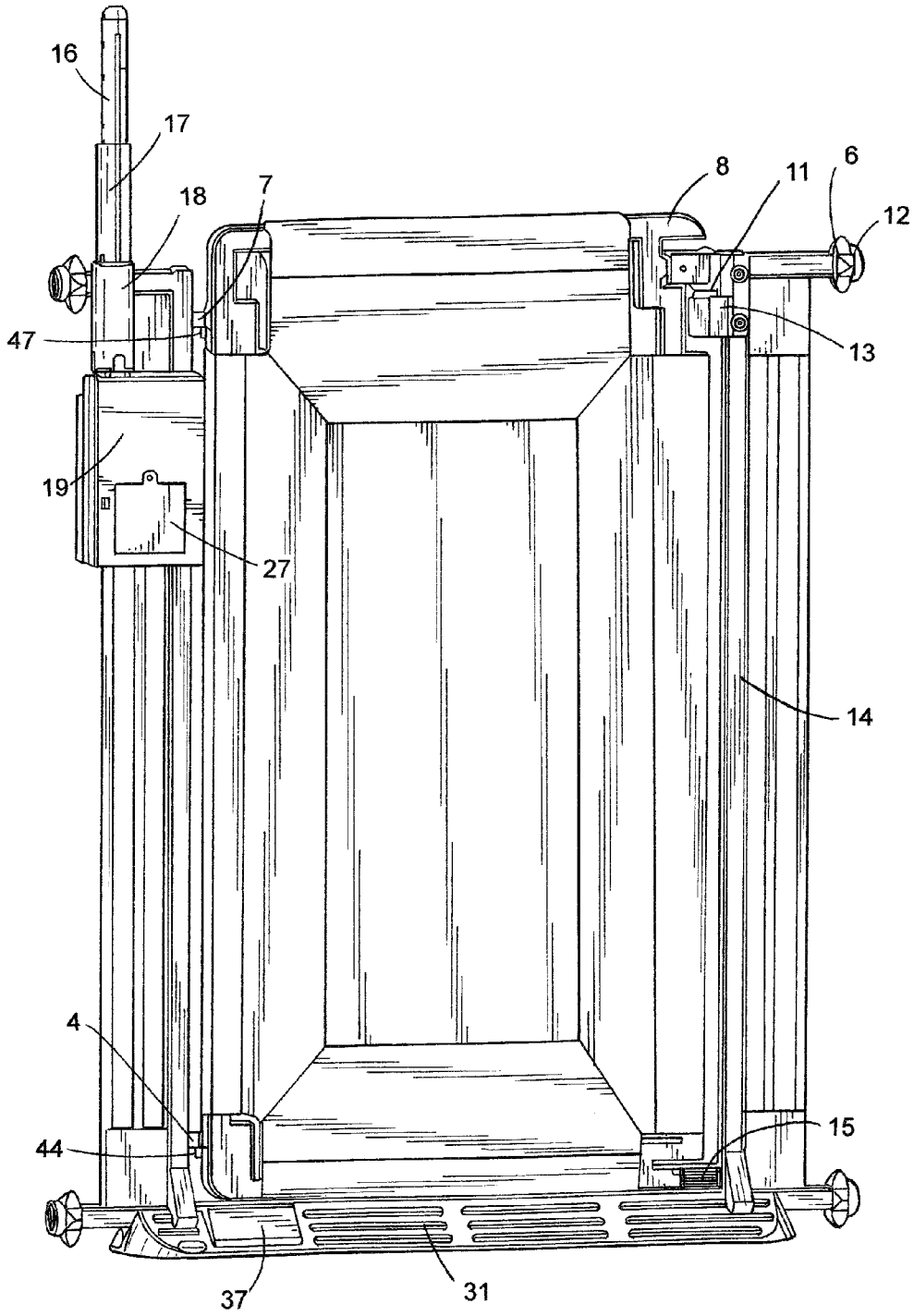
FIG. 1 is a front perspective view of the gate assembly with the gate in a closed position, but unlocked.
Figure 2:
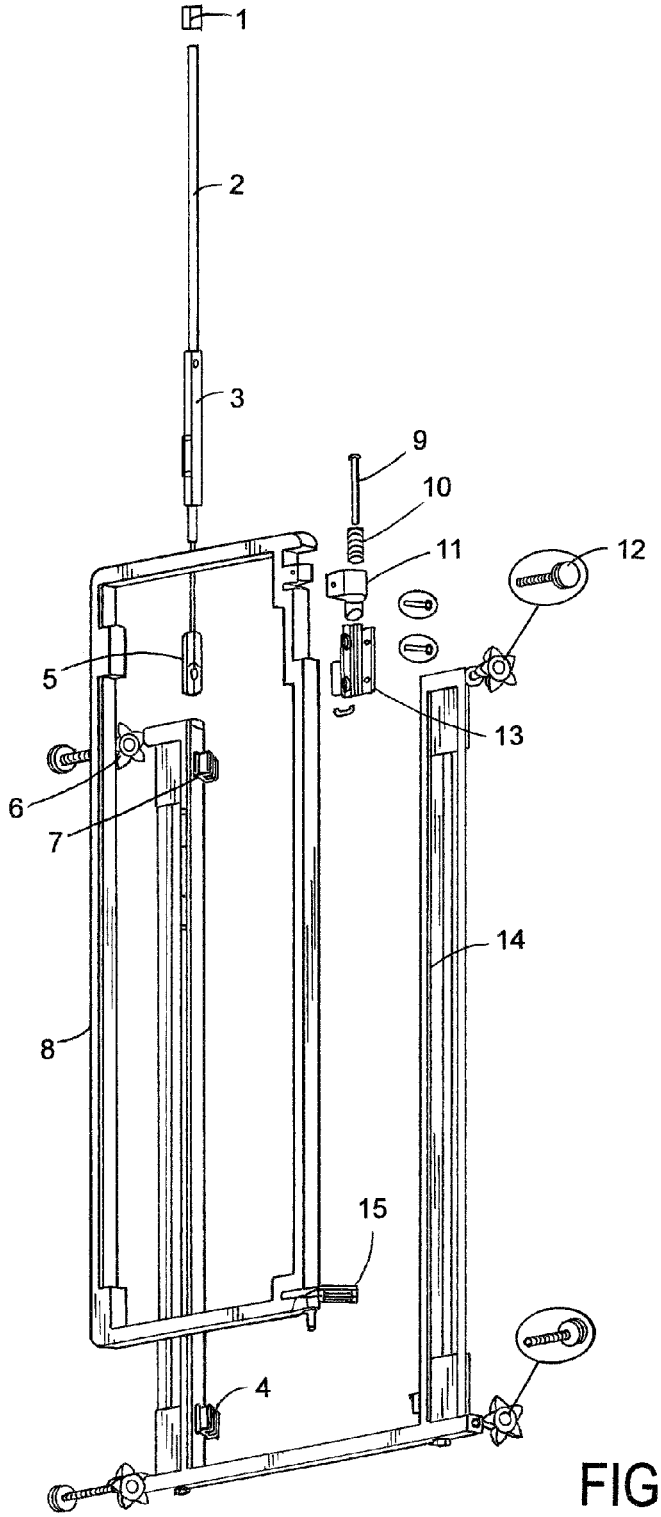
FIG. 2 is an exploded perspective view of the gate assembly with the cover omitted for clarity.
Figure 3:
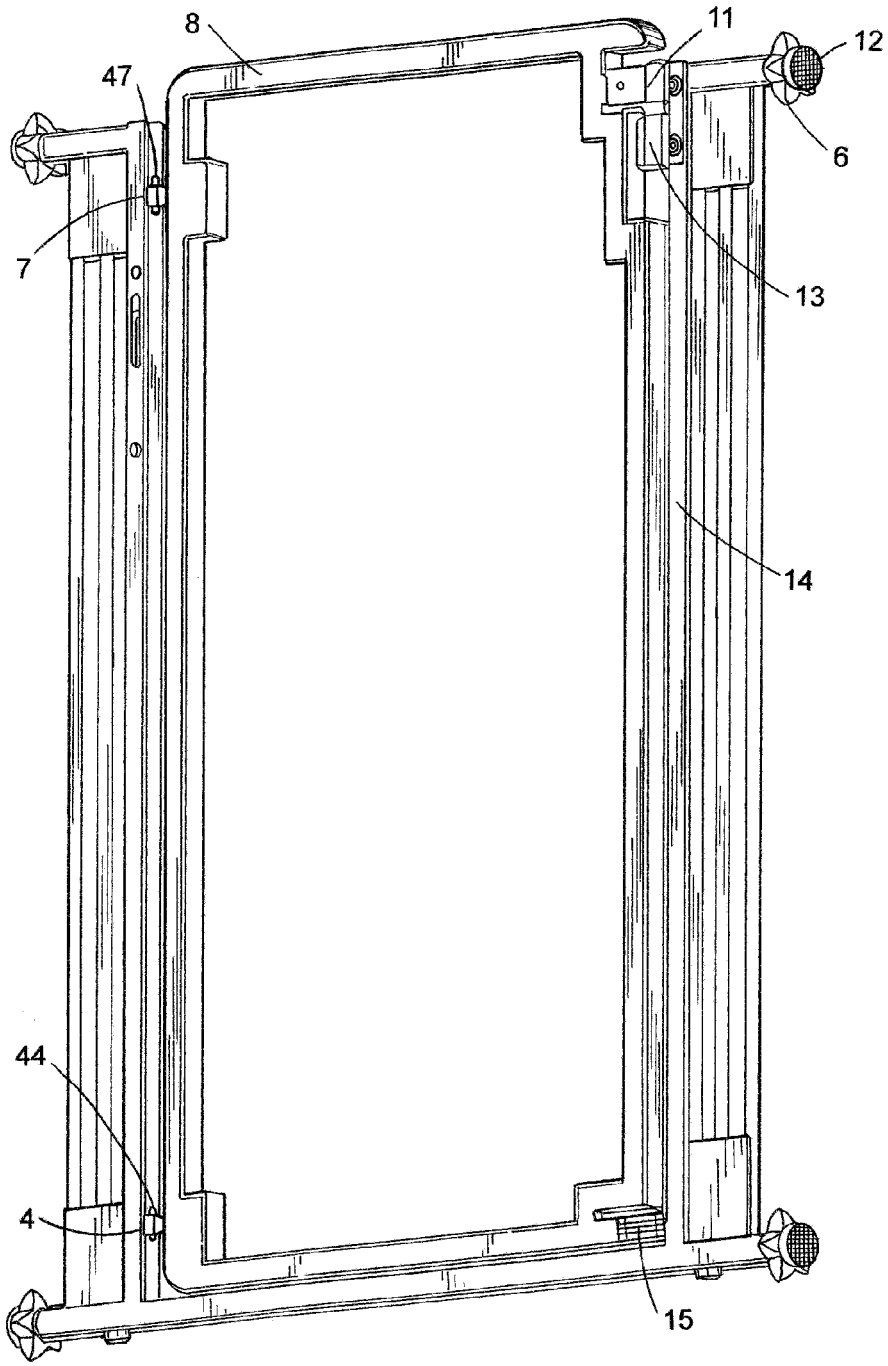
FIG. 3 is a perspective view of part of the gate assembly without the cover and with the gate closed and latched/locked.
Figure 4:
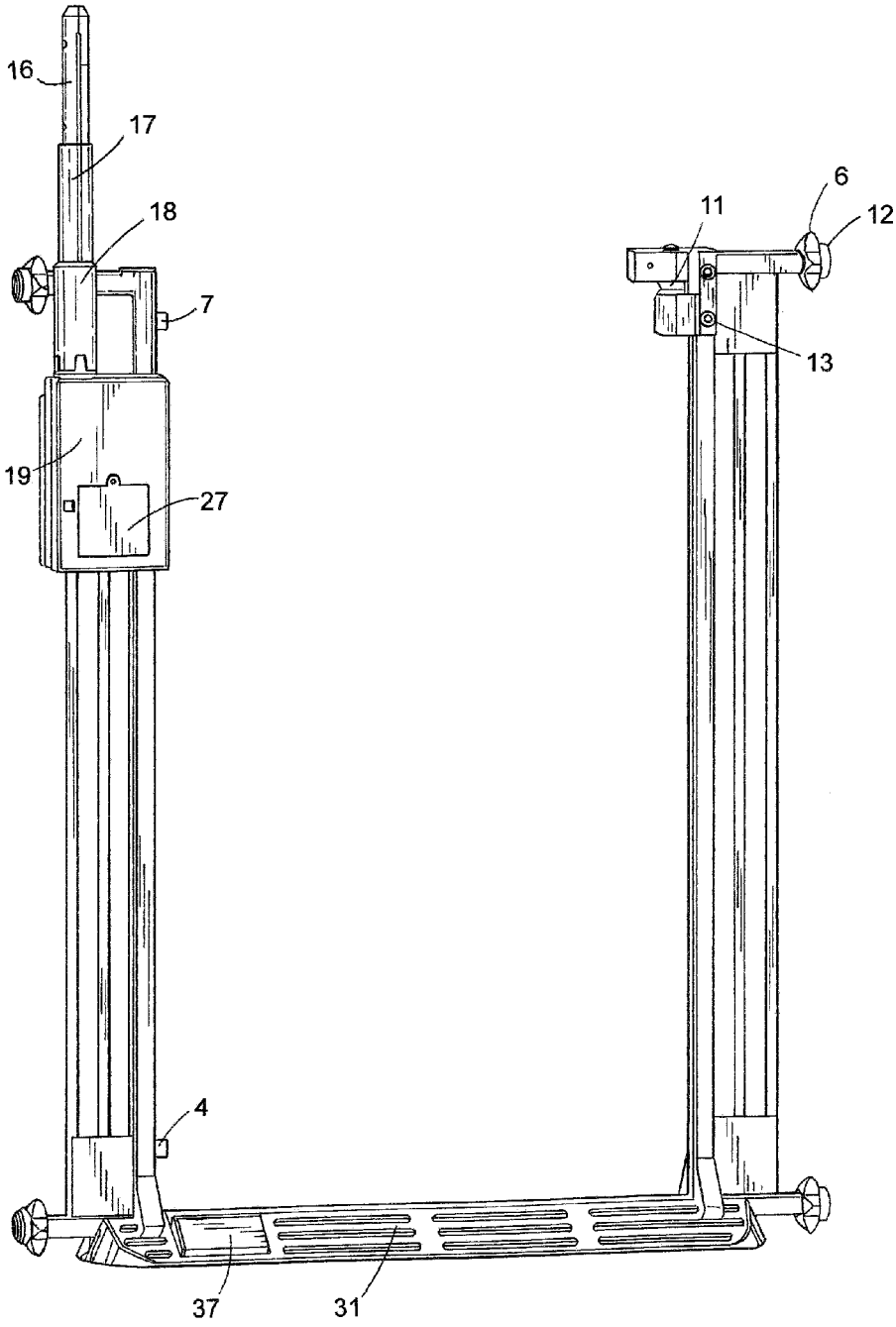
FIG. 4 is a perspective view of the barrier frame of the gate assembly.
Figure 5:
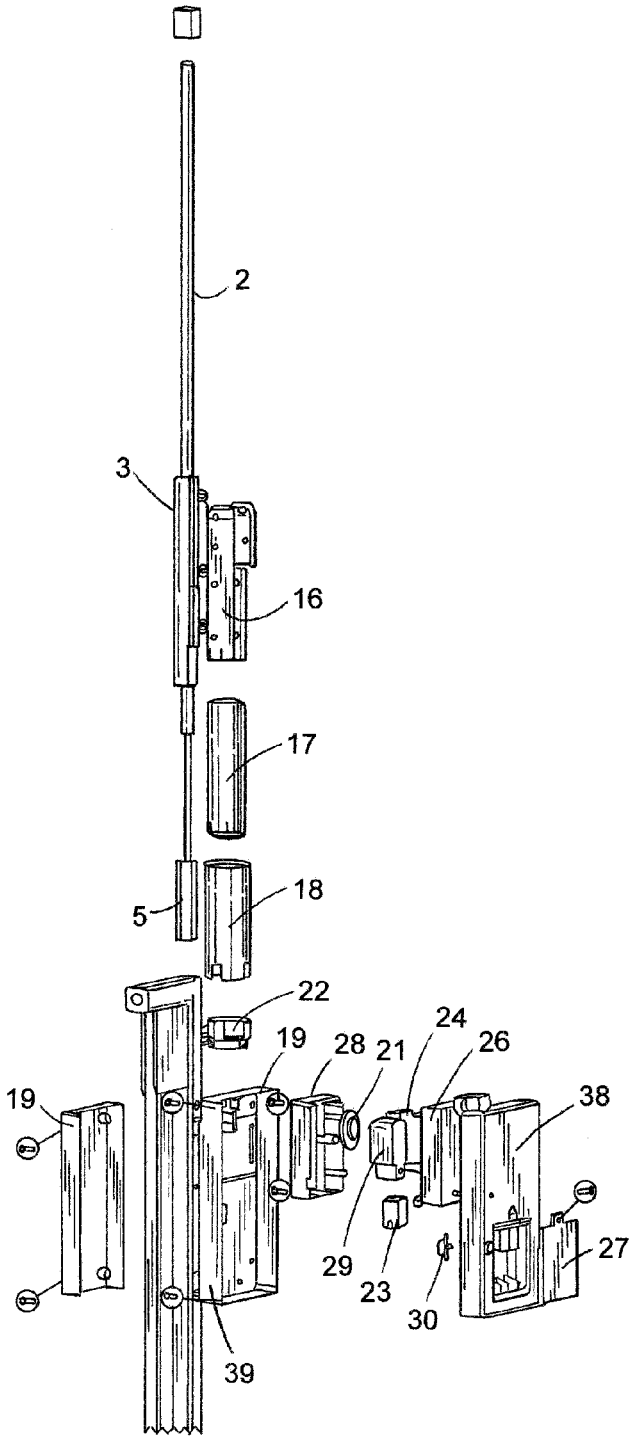
FIG. 5 is a fragmentary exploded perspective view of the barrier frame showing the motor, gears and antenna/mast for carrying the PIR detectors at the top.
Figure 8:
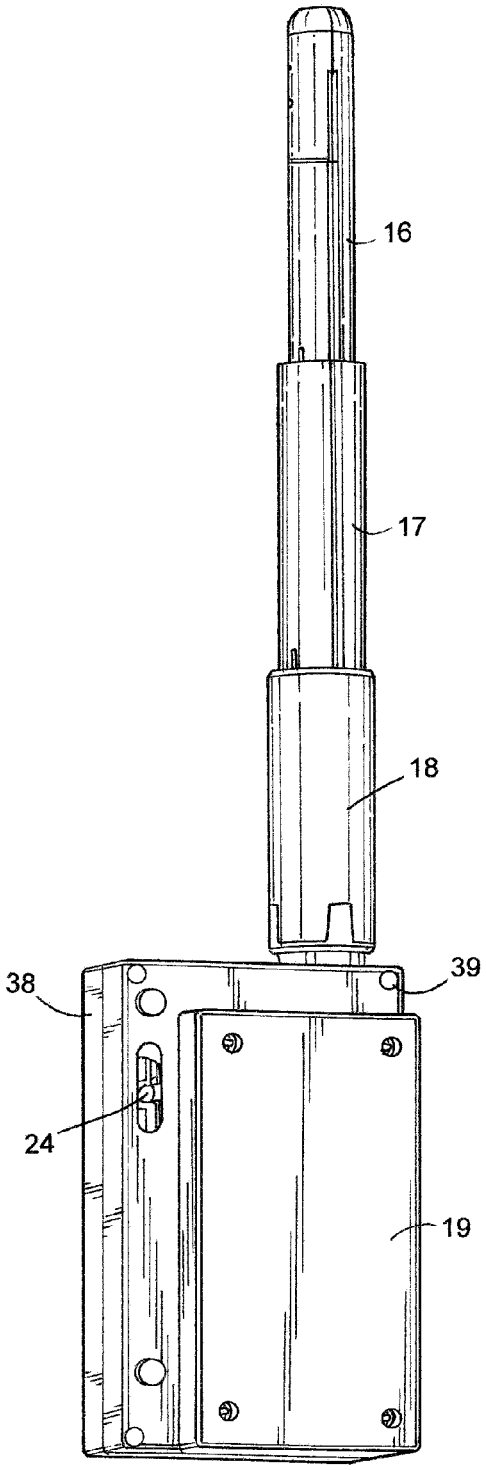
FIG. 8 is a perspective view of the motor housing/gearbox/battery box and antenna.
Figure 9:
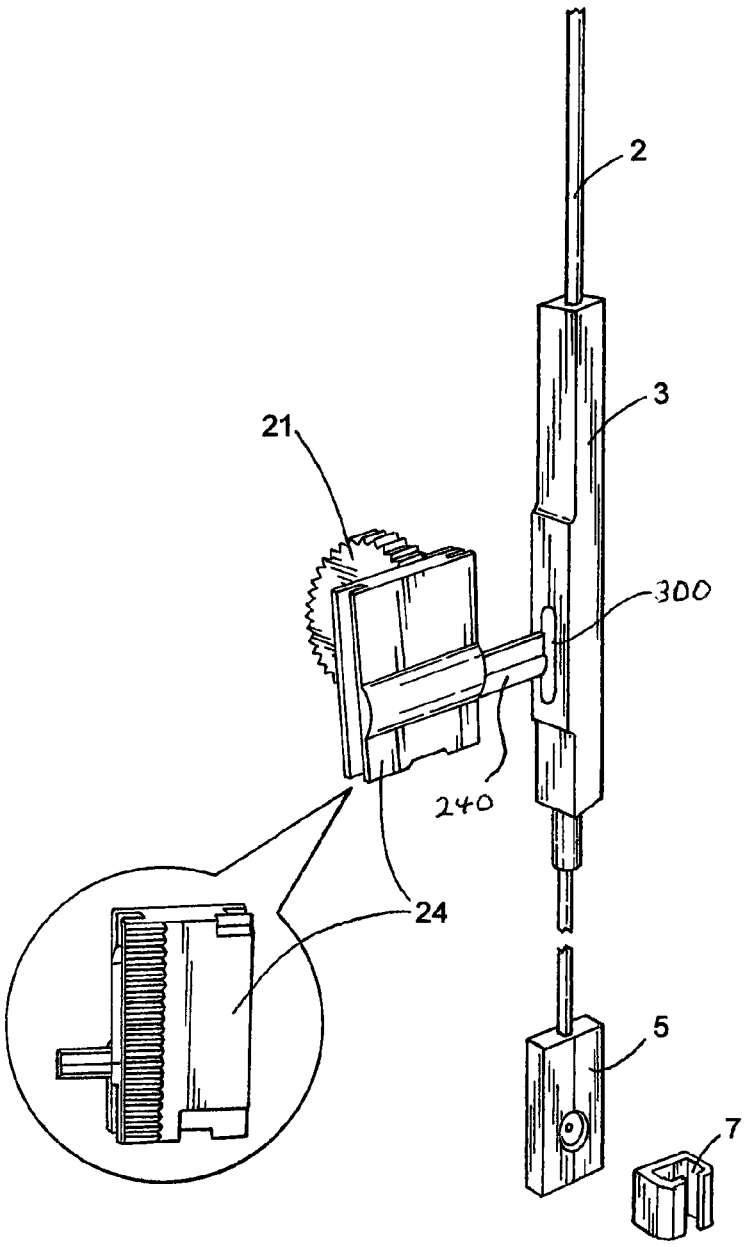
FIG. 9 is a fragmentary exploded view of the movable latching mechanism on the barrier frame showing that the spigot of the rack gear plate is receivable for limited free relative vertical movement in the vertical slot in the latching rod to permit lost motion between the rod and the gear plate.

Infra red detectors (not shown) are mounted, facing in opposite directions, on a top section 16 of a telescopic mast, having middle and lower sections, 17 and 18, respectively of respectively increasing diameters. The lower section 18 is mounted on an antenna retainer 22 at a top of a battery box 38/39, as shown particularly in FIGS. 5 and 8. Wiring extends internally of the mast, connecting the detectors to control circuitry in the battery box 38/39. Telescopic movement of the mast permits the detection height to be adjusted as desired when the gate assembly is mounted in a passageway, to accommodate people of different height. Suitably, the detection angle extends from the horizontal plane up through a conical angle of 60 degrees and the detection distance for body temperature is approximately 0.5 meter.

The frame has width adjustable, wall mounting means comprising threaded rods 12 threadingly mounted on the frame to extend longitudinally from opposite corners of sides so as to be axially extensible by manual rotation of locking thumbwheels 6 to bring respective fee ends into jamming engagement with opposite walls of a passageway thereby mount the baby gate assembly in passageways of different widths, doorways or between a wall and stair posts.

This structure also enables the baby gate to be readily moved from place to place in the home simply by manually loosening the threaded rod locking thumbwheels and rotating the threaded rods.

An extension frame may be also be added on to the frame assembly when required.

Figure 13:
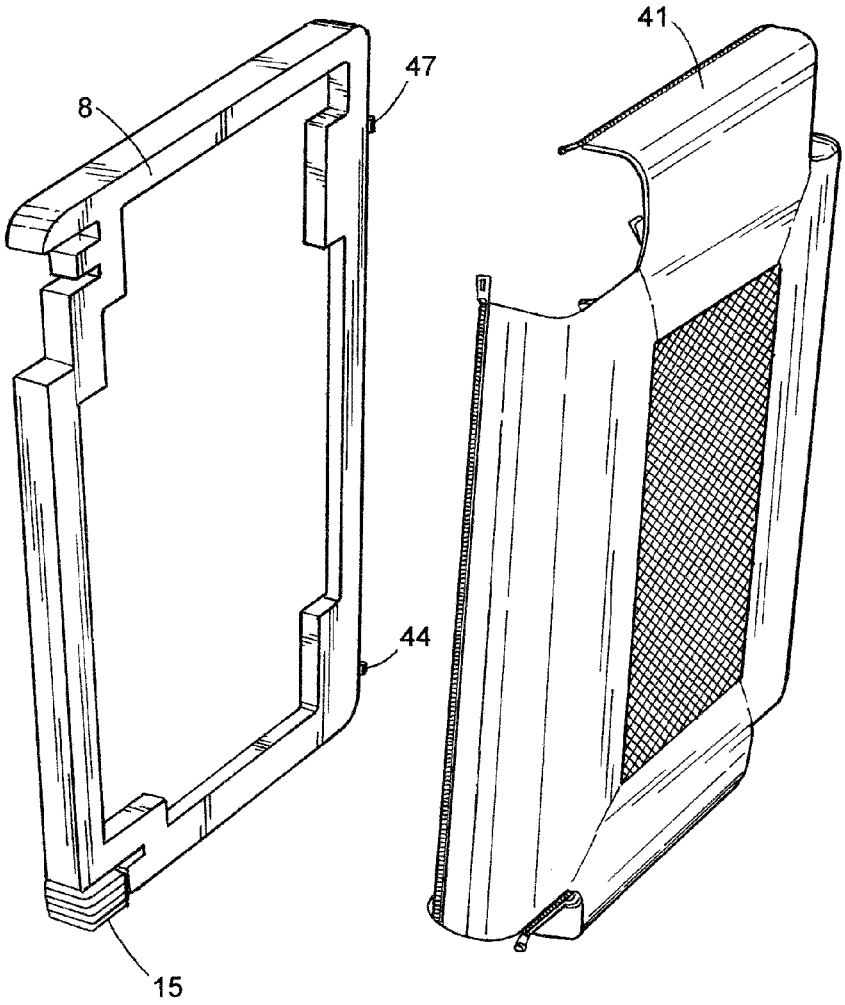
FIG. 13 is a schematic perspective view of the gate frame and the soft fabric cover disassembled by unzipping therefrom.
Figure 14:
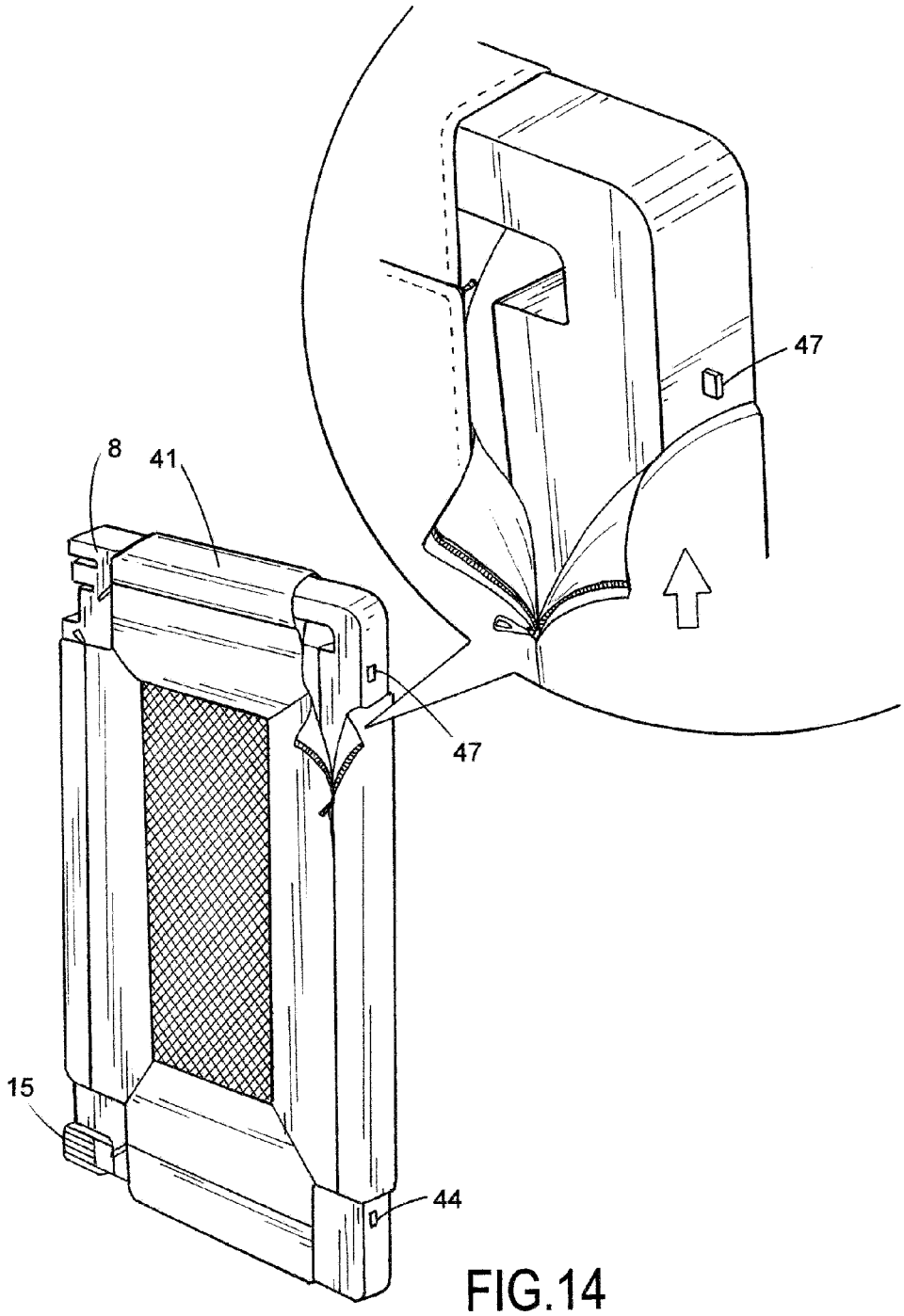
FIG. 14 is a schematic perspective view of the gate frame and the soft fabric cover assembled therewith.

As shown in FIGS. 13 and 14, the metal frame of the gate is provided with a (zipped) cover 41 of soft fabric removable for replacement when worn or for cleaning.

DESCRIPTION OF BLOCK AND CIRCUIT DIAGRAMS WITH PIR SENSORS

Figure 16:
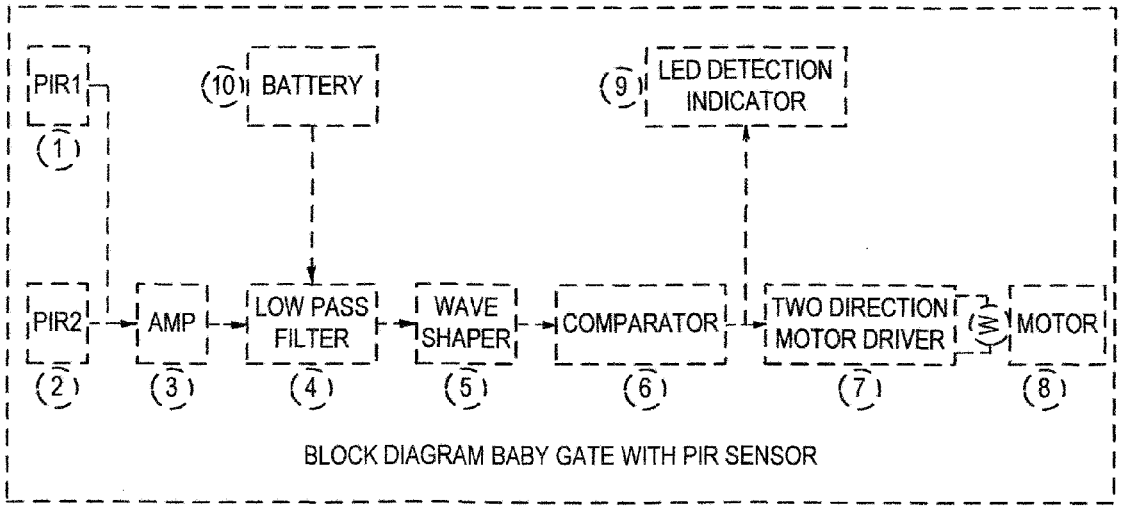
FIG. 16 is a bock diagram showing the main operating steps of the PIR sensor and associated circuitry.
Figure 15:
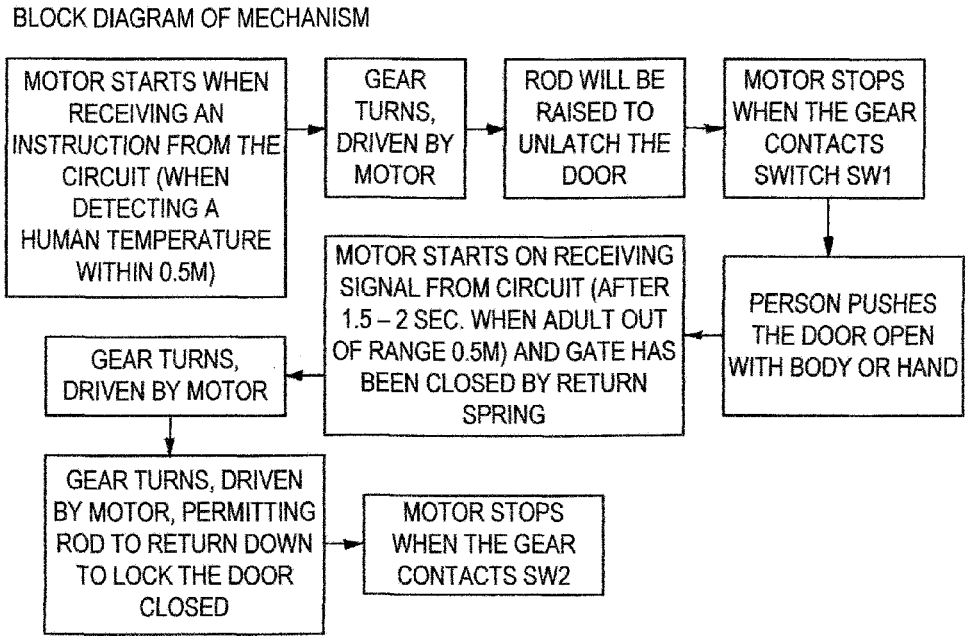
FIG. 15 is a block diagram showing the main mechanical operating steps.
Figure 17:
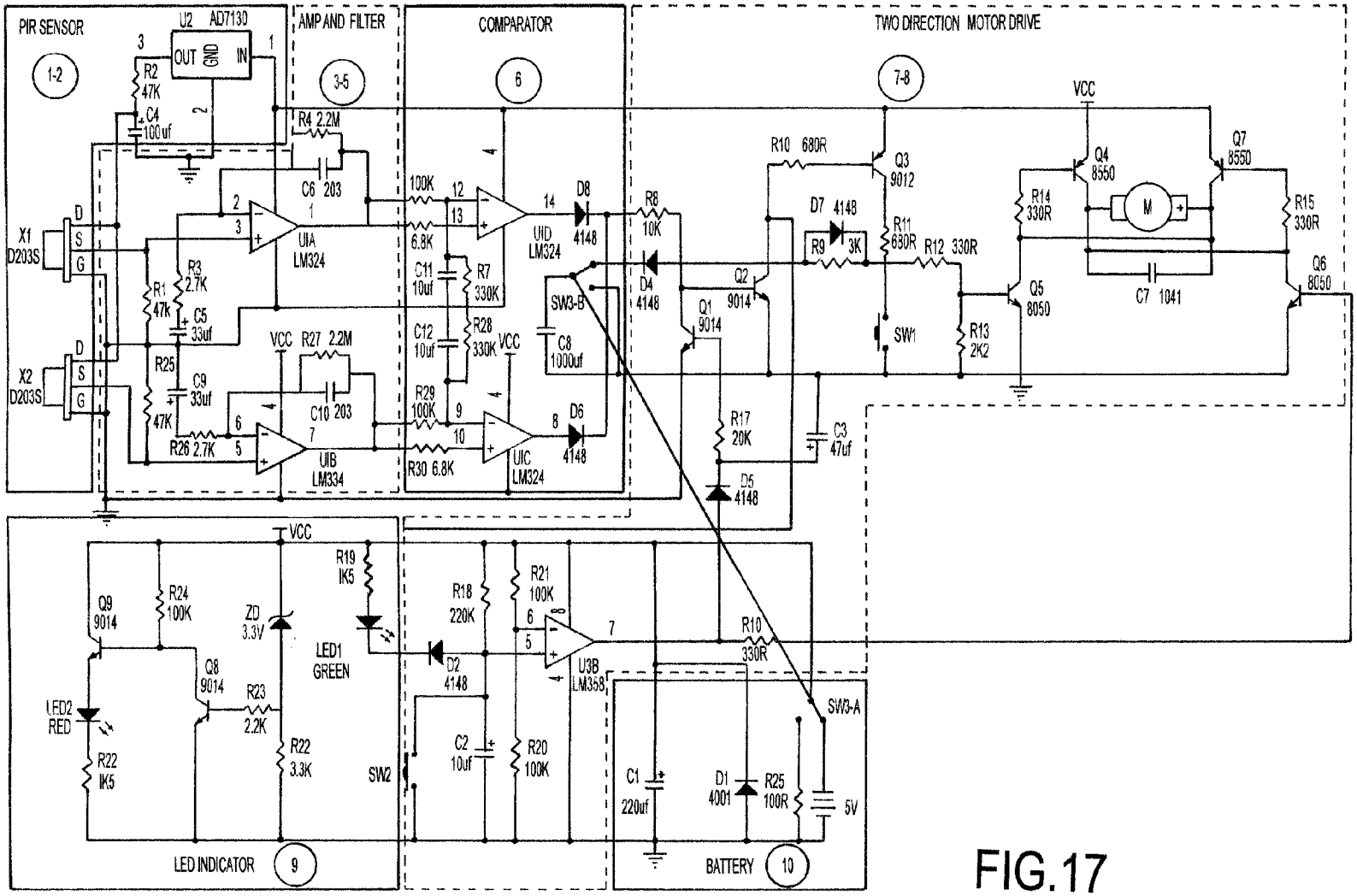
FIG. 17 is a diagram of the electronic circuitry for enacting the steps of FIG. 16.
Figure 18:
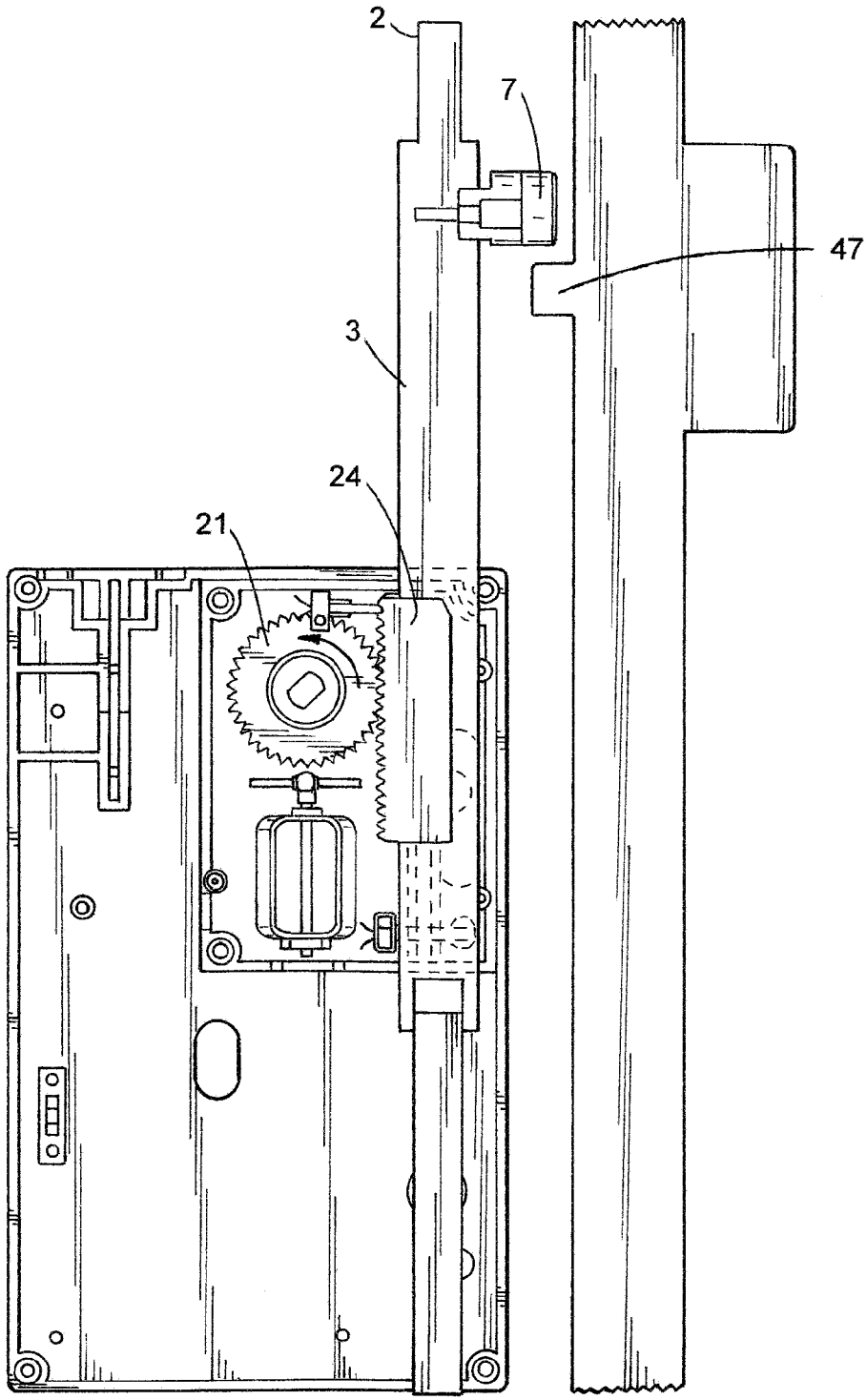
FIG. 18 is a schematic elevational view of the latching assembly on the barrier frame showing the related motor gear and rod movement.

Briefly stated, as shown in FIGS. 16 and 17, blocks 1 and 2 are IR receivers. In block 3, an IR signal detected by the receivers is amplified and analysed, demodulated in block 4 and shaped in block 5. In block 6 the (wave)shaped signal is compared with a preset set control temperature signal and if higher, triggers the circuit in block 7 to drive the motor forward in block 8 to raise the latching members to release the gate catches, unlocking the gate also lighting a status LED.

More, specific details of respective circuit blocks are described below:

The PIR sensors circuit (Blocks 1&2) contains sensor 1 (X1 D203s), sensor 2 (X2 D203s),R2, C4 and U2 (regulator AD7130). The U2 (regulator AD7130) regulates the voltage for the two PIR sensors. The two PIR sensors detect infrared radiation emitted from a human body and are mounted on opposite sides of the top of the antenna/mast facing forwardly and rearwardly of the gate.

The Amplifier with low pass (Blocks 3&5) filter contains U1A, U1B, R4, R1, R3, R25, R26, R27, C6, C5, C9, and C10. U1A and U1B amplify the signals detected in respective channels with a low pass filter feature filtering noise.

The Comparator (Block 6) contains U1D, U1C, D3, D6, R5, R6, R7, R29, R30, R28, C11 and C12. The circuit compares the signal level with a threshold value and only triggers the motor drive circuit if the detected signal exceeds the threshold value. Operational amplifiers U1D and U1C are Motorola parts LM324.

The bidirectional motor driver circuit (Blocks 7&8) contains Q1, Q2, Q3, Q4, Q5, Q6, Q7, biasing transistors (Q1-Q7), switches SW1, SW2, and U313 (Motorola part LM358) Transistors Q1-Q7 determine the direction of motor movement. Comparator's output control U313 is used to prevent a false trigger. SW l and SW2 limit the rotation of the motor in each direction.

The LED detection indicator circuit (Block 9) contains Q8, Q9, R22, R23, R24, RI9, ZD, LED1 and LED2. The red LED2 is for battery indication and green LED1 indicates IR detection. LED2 remains on to warn of a low battery condition. The power supply or battery circuit (Block 10) contains C1, D1, R25, SW3A, SW3B and the battery. SW3A and SW3B is a slide switch with 2 pole-2 position. It is a power on off switch.

Figure 7:
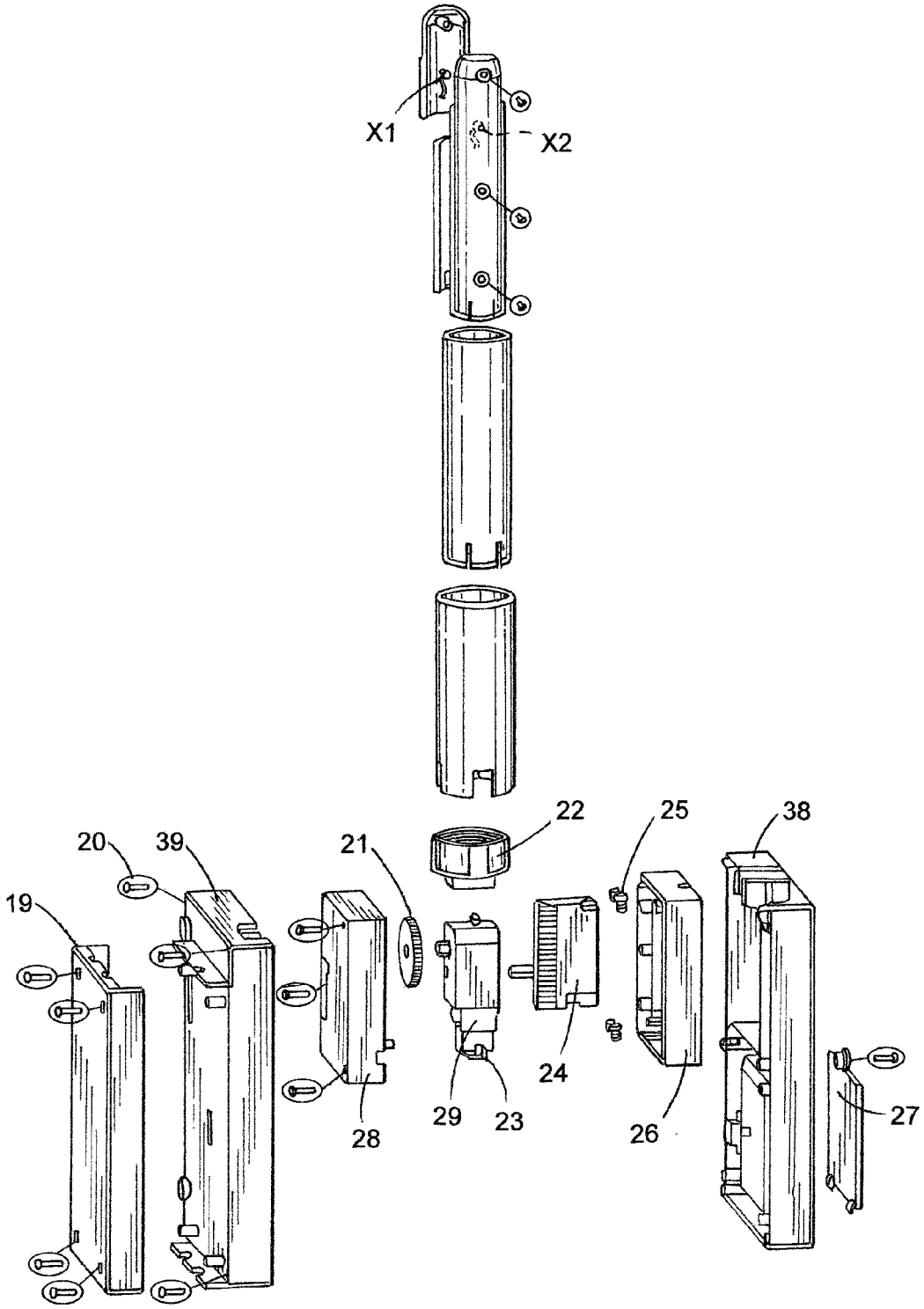
FIG. 7 is an exploded perspective view from a different angle than FIG. 5 of the motor, gears and antenna/mast for carrying the PIR detectors at the top.

Upper microswitch 1 (SW1) (25), (also FIGS. 7 and 18), is a motor-forward status switch, actuation of which by engagement with the rack gear plate 24, limits the forward motion of the motor 23 when it has raised the rod 2 carrying lower and upper clevis form latch members 4 and 7 above the tab-like gate latches, releasing them to unlock the gate 8. Lower microswitch 2 (SW2) is a motor-backward location status switch also engagable by the rack gear plate 24 to limit the return movement of the motor when the rod has lowered the latch members 4 and 7 into receiving engagement with the gate latches to lock the gate. Thus, when the PIR receiver detects a person, the collective ID, IC358 pin7 voltage will rise to a high level to drive the motor forward to open the gate. (In the meantime the capacitor C2 will be charged). After the switch closes, signaling the system to stop the motor, the capacitor C2 will be recharged through R14 so that Pin 3 voltage level will slowly increase until, a couple of seconds after the IR signal indicating continuing presence of a person adjacent the gate is no longer detected, pin3 voltage level will be higher than pin 2. Then the voltage of pin 1 will become high and drive the motor backward to lower the rod 2 to lock the gate, closing lower switch SW2 at the end of travel to stop the motor. The delay provides sufficient time for the gate to be returned by the biasing spring 10 to the latching position after the person has pushed open the gate and walked through, clear of the gate.

An alternative embodiment utilizing RFID for designation is shown in the block diagrams of FIGS. 21*a* and 21*b* in which: the transmitter:

1. Generates a secure code and transmits the instruction
2. Combines the secure code and carrier signal 2a. Generates a carrier signal, carrier frequency (433 MHz for Europe and 303 MHz for USA)

3. Amplifies the carrier signal

3a. Adjusts the transmit distance, and

The Receiver:

1. Receives the carrier signal from the transmitter when within 0.5 m

1a. When the signal is received, the green LED will light up.

2. Demodulates the signal received signal
3. Shapes the waveform
4. Decodes the secure code
5. If the signal is correct, it will trigger the circuit; if incorrect, it will be ignored 6-7. The trigger circuit will drive the motor, so as to open/lock the upper and lower lock 8. When the signal is detected, the LED will light up.

The transmitter circuit utilizes 4 pcs IC being part nos PT81977BP sold by Pericom Technologies Inc (Shanghai, Hong Kong and California) for transmitter encoding and receiver encoding utilizes PT978P also sold by Pericom Technologies. LM 358 (Motorola) for the receiver comparator and HT7530 (voltage regulator.

PARTS LIST

1 Latching rod cover
2 Latching rod
3 Upper frame latch retainer
4 Lower frame latch member
5 Lower frame latch retainer
6 Thumbwheel nuts ×4
7 Upper frame latch member
8 Gate
9 Gate hinge pin
10 Gate Biasing spring
11 Upper (rising) gate hinge member
12 Threaded (adjustment) bolt ×12
13 Upper frame hinge member
14 Frame (post)
15 Lower Frame Hinge
16 Antenna/mast upper section
17 Antenna/mast middle section
18 Antenna/mast middle section
19 Battery cover
20 Screw
21 Pinion gear
22 Antenna Retainer
23 Motor
24 Rack gear plate
25 Microswitch
26 Gearbox cover
27 Battery box door
28 Gearbox
29 Motor housing
30 On/Off switch
31 Ramp/step
32 Lever
33 Spring
34 Pedal cover plate
35 Screw
36 Bolt
37 Pedal ×2
38 Battery box part
39 Battery box part

The invention claimed is:

1. A baby gate assembly comprising:

a barrier frame for bridging a passageway and defining a U-shaped gateway;

a gate mounted in the gateway for swinging movement between open and closed positions, respectively, out of and into alignment with the frame, thereby permitting and preventing a person walking through the gateway, respectively, cooperating latching means on the frame and gate releasably engagable with each other to lock the gate in the closed position preventing a person walking through the gateway;

means on the frame for detecting the presence of a designated person adjacent the gate by detecting a predetermined physical property associated with the designated person and for automatically disengaging the latching means to unlock the gate to permit the designated person detected to open the gate by hands free operation and to walk through the gateway and for automatically re-engaging the latching means to lock the gate in the closed position preventing a person walking through the gateway when the designated person is no longer detected adjacent the gate latching means being moveable between latched and unlatched positions without moving the detecting and disengaging means;

and, a pedal mechanism operably connected to the cooperating latching means when engaged to lock the gate in the closed position, to disengage the latching means to permit the designated person to open the gate by hands free operation and to walk through the gateway when the detecting and disengaging means is inoperable.

2. The baby gate assembly according to claim 1 wherein the detecting and disengaging means comprises a reversable stepping motor operated by signals received from the detecting and disengaging means means.

3. The baby gate assembly according to claim 1 wherein the gate is spring biased into the closed position and the means for detecting and disengaging means retains the latching means in the disengaged position throughout detection of the person and for a predetermined period of time afterwards to provide sufficient time for the spring to return the gate into alignment with the frame so that the latching means are aligned for re-engagement, before returning the latching means to a re-engaged position.

4. The baby gate assembly according to claim 3 wherein the pedal mechanism is spring biased into a latched position so that it cannot be depressed by an infant unaided.

5. The baby gate assembly according to claim 1 wherein the person is designated by the physical property of minimum height so that the latching means will not be disengaged by the presence of an infant.

6. The baby gate assembly according to claim 5 wherein the detecting and disengaging means comprises at least one infra-red detector positioned to detect and respond only to infra red from a source at a height corresponding to a body height of an adult, and not below such height.

7. The baby gate assembly according to claim 6 wherein said at least one infra red detector is mounted on a telescopic mast operable to permit the detection height to be adjusted as desired when the gate assembly is mounted in a passageway, to accommodate people of different height.

8. The baby gate assembly according to claim 6 wherein a detection angle extends from the horizontal plane up through a conical angle of 60 degrees and a detection distance for body temperature is approximately 0.5 meter.

9. The baby gate assembly according to claim 6 wherein said at least one detector comprises two infra red detectors mounted facing in respective opposite directions on respective opposite sides of the gateway to detect the presence of adults adjacent either side of the gate.

10. The baby gate assembly according to claim 9 wherein an operational threshold of detection is one of a predetermined value and a value derived from a comparison of infra red intensities received by respective detectors.

11. The baby gate assembly according to claim 1 wherein the person is designated by one of the physical property of a wireless transmitter signal and the physical property of a remotely detectable tag on the person's body.

12. The baby gate assembly according to claim 1 wherein the person is designated by the physical property of their voice and a voice recognition system is connected to the detecting and disengaging means and includes a memory circuit mounted on the gate and which can be trained to recognize a particular persons voice thereby to designate that person.

13. The baby gate assembly according to claim 1 wherein the U-shaped gateway comprises opposite vertical gate posts joined by a transverse step, one side edge of the gate being pivotally mounted to one gate post and the latching means comprising catch means on an opposite, free side edge of the gate and a cooperating catch member mounted on a gate post for movement into and out from engagement with the catch means.

14. The baby gate assembly according to claim 13 wherein the catch member on the frame is linked for lost motion to both the detecting and disengaging means and the pedal mechanism so that when either one of the detecting and disengaging means and the pedal mechanism is operated to move the catch member to an unlocked position, another of the detecting and disengaging means and the pedal mechanism is not moved with the catch member.

15. The baby gate assembly according claim 14 wherein the pedal mechanism comprises a pedal operatively connected to depress one end of a rocking lever and the catch member comprises a rod formed with an axially extending slot with a top blind end and mounted for vertical, axial sliding movement on the gate post and having a lower end aligned over an opposite end of the rocking lever, the detecting and disengaging means having a horizontal spigot received in the axially extending slot at the top blind end and for vertical relative sliding movement, so that operation of the detecting and disengaging means raises the spigot and thereby the rod away from the lever to disengage the catch member and unlock the gate without moving the pedal mechanism and, so that depression of the pedal rocks the lever to raise the rod to disengage the catch member and unlock the gate, with relative vertical sliding movement of the spigot in the axially extending slot thereby obviating movement of the detecting and disengaging means.

16. The baby gate assembly according to claim 15 wherein, when the spigot is lowered to the latching position, the rod falls under gravity, lowering the catch member on the frame into latching engagement with the catch means on the gate.

17. The baby gate assembly according to claim 15 wherein, the detecting and disengaging means comprises a reciprocal stepping motor and the spigot is carried by a rack gear plate linked to the motor for vertical reciprocation between upper and lower position actuating detecting microswitches.

18. The baby gate assembly according to claim 1 wherein, the frame has wall mounting means for width adjustment of the frame, comprising threaded rods threadingly mounted on the frame to extend longitudinally from opposite sides so as to be axially extensible by manual rotation to bring respective free ends of the threaded rods into jamming engagement with opposite walls of a passageway thereby mount the baby gate assembly in passageways of different widths, doorways or between a wall and stair posts.

19. The baby gate assembly according to claim 18 wherein locking thumbwheels are operatively mounted on the threaded rods to prevent accidental rotation of the threaded rods locking them in a selected axial position ensuring reliable retention of the bay gate assembly in position.

20. The baby gate assembly according to claim 1 wherein the gate comprises a metal frame with a cover of soft fabric removable for replacement when worn and for cleaning.

* * * * *